US010311668B1

(12) United States Patent
Halvorson

(10) Patent No.: US 10,311,668 B1
(45) Date of Patent: Jun. 4, 2019

(54) GAMING SYSTEM AND METHOD HAVING AWARD ENHANCEMENTS BASED ON STORED SYMBOLS

(71) Applicant: ADP GAUSELMANN GMBH, Espelkamp (DE)

(72) Inventor: Michael Charles Halvorson, Las Vegas, NV (US)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

(21) Appl. No.: 16/021,740

(22) Filed: Jun. 28, 2018

(51) Int. Cl.
*A63F 9/24* (2006.01)
*G07F 17/32* (2006.01)
*G07F 17/34* (2006.01)

(52) U.S. Cl.
CPC ..... *G07F 17/3213* (2013.01); *G07F 17/3244* (2013.01); *G07F 17/34* (2013.01)

(58) Field of Classification Search
CPC ..... G07F 17/34
See application file for complete search history.

(56) References Cited

U.S. PATENT DOCUMENTS 5,833,537 A 11/1998 Barrie
6,186,894 B1 2/2001 Mayeroff
7,794,320 B2 * 9/2010 Baerlocher ..... G07F 17/32 463/16
7,846,018 B2 12/2010 Baerlocher
8,337,300 B2 12/2012 Bowers et al.
8,491,375 B2 7/2013 Low
8,585,485 B2 11/2013 Guinn
9,230,409 B2 1/2016 Pawloski
9,928,691 B2 3/2018 Olive
2002/0043759 A1 4/2002 Vancura
2002/0045474 A1 4/2002 Singer et al.
2004/0048646 A1 3/2004 Visocnik
2004/0053673 A1 3/2004 Mishra
2008/0045302 A1 2/2008 Low
2008/0248865 A1 10/2008 Tedesco et al.
2009/0221353 A1 9/2009 Joung
2010/0029381 A1 2/2010 Vancura
(Continued)

FOREIGN PATENT DOCUMENTS

AU 201490132 8/2014
AU 2015210489 A1 2/2016
(Continued)

*Primary Examiner* — James S. McClellan
*Assistant Examiner* — Kevin M Carter
(74) *Attorney, Agent, or Firm* — Resolute Legal PLLC

(57) ABSTRACT

Various embodiments of a gaming system and method are disclosed as having awards or award enhancements based on a plurality of storage symbols. The gaming system enables the plurality of storage symbols to be collected and stored over multiple games. In some embodiments, the gaming system collects a wager for at least one or more of the games. In some embodiments, when the gaming system determines that a quantity of stored plurality of storage symbols is equal to or greater than a predetermined quantity of storage symbols, the gaming system evaluates the stored plurality of storage symbols for winning conditions. In some embodiments, the gaming system provides one or more awards or award enhancements associated with the winning conditions.

19 Claims, 12 Drawing Sheets

(56) References Cited

U.S. PATENT DOCUMENTS

2010/0120489 A1* 5/2010 Meyer ..... G07F 17/32 463/19
2010/0190542 A1 7/2010 Mizue
2010/0197377 A1 8/2010 Aoki et al.
2011/0003627 A1 1/2011 Nicely et al.
2011/0117989 A1* 5/2011 Kennedy ..... G07F 17/34 463/20
2011/0136565 A1* 6/2011 Low ..... G07F 17/34 463/20
2012/0231868 A1 9/2012 Guinn
2012/0292588 A1 11/2012 Watkins et al.
2014/0018146 A1* 1/2014 Zielinski ..... G07F 17/3267 463/20
2014/0087821 A1 3/2014 Zoltewicz et al.
2014/0087860 A1* 3/2014 Basallo ..... G07F 17/3258 463/29
2014/0087861 A1* 3/2014 Basallo ..... G07F 17/3244 463/29
2014/0309010 A1 10/2014 Pawloski
2015/0080096 A1* 3/2015 Saunders ..... G07F 17/34 463/20
2015/0141114 A1* 5/2015 Davis ..... G07F 17/3213 463/20
2015/0248810 A1 9/2015 Wortmann et al.
2016/0042597 A1 2/2016 Olive
2016/0253873 A1 9/2016 Olive
2017/0032610 A1* 2/2017 Loz ..... G07F 17/3213
2017/0154498 A1 6/2017 Olive
2018/0082535 A1 3/2018 Filipour et al.
2018/0082546 A1 3/2018 Mariscal et al.
2018/0218572 A1* 8/2018 Caputo ..... G07F 17/3262
2018/0225914 A1 8/2018 Heenan et al.
2018/0261045 A1* 9/2018 Takahara ..... G07F 17/3213
2018/0268655 A1 9/2018 Olive

FOREIGN PATENT DOCUMENTS

AU 2016900462 2/2016
AU 2016100230 A4 3/2016
AU 2016202727 A1 5/2016
AU 2016101967 A4 12/2016
AU 2017200840 A1 3/2017
AU 2017204560 A1 7/2017
AU 2017101097 A4 9/2017
AU 2017101098 A4 9/2017
AU 2017101629 A4 12/2017
AU 2017101730 A4 1/2018
AU 2017101731 A4 1/2018

* cited by examiner

GAMING SYSTEM AND METHOD HAVING AWARD ENHANCEMENTS BASED ON STORED SYMBOLS

FIELD OF THE INVENTION

The present disclosure relates to gaming devices.

BACKGROUND OF THE INVENTION

Gaming machines that accept wagers in exchange for the opportunity to win awards or prizes are known. Game machines that offer new ways to win awards or prizes are needed to gain and retain players' interest in the gaming machines.

SUMMARY OF THE INVENTION

Various embodiments of a gaming system and method are disclosed as having awards or award enhancements based on a plurality of storage symbols. In some embodiments, the gaming system enables the plurality of storage symbols to be collected and stored over one or more plays of a game. In some embodiments, the gaming system stores the plurality of storage symbols between plays of a game such that after one play of a game is completed, the stored plurality of storage symbols are available for the next play of the game. In some embodiments, the gaming system collects a wager for at least one or more different plays of the game. In some embodiments, the game played is the same game. In alternative embodiments, the stored storage symbols are available over different plays of different games. In some embodiments, when the gaming system determines that a quantity of stored storage symbols is equal to or greater than a predetermined quantity of storage symbols, the gaming system evaluates the stored plurality of storage symbols for winning conditions. In some embodiments, the gaming system provides one or more awards or award enhancements associated with any determined winning conditions.

In some embodiments of a gaming system and method having awards or award enhancements based on a plurality of storage symbols, the gaming system generates storage symbols based on matches between different sets of symbols. In some embodiments, for a play of a game, the gaming system may generate a storage symbol based on an association between a generated accumulator symbol in a first symbol display area and a generated game symbol in a second symbol display area. The gaming system may collect and store the generated storage symbol so that it is available in at least one next play of the game for evaluating winning conditions and determining awards or award enhancements. The gaming system may store and display the generated storage symbol in a symbol storage area, where the symbol storage area is distinct and apart from the first symbol display area and the second symbol display area. In some embodiments, the gaming system determines if the symbol storage area includes a predetermined quantity of storage symbols.

If the gaming system determines that the symbol storage area includes the predetermined quantity of storage symbols, the gaming system evaluates the storage symbols in the storage symbol area to determine if any winning conditions exist associated with the storage symbols in the symbol storage area. If any winning conditions exist, the gaming system determines any appropriate awards or award enhancements associated with the storage symbols in the symbol storage area. In some embodiments, the gaming system may remove at least one of the storage symbols from the symbol storage area that is associated with a winning condition, but leave storage symbols in the symbol storage area that were not associated with winning conditions. The gaming system may use these remaining or leftover storage symbols to build up a new collection of storage symbols (e.g., to the predetermined quantity of storage symbols) for use in later plays of the game (e.g., for more awards or award enhancements). However, in some embodiments, the gaming system removes all of the storage symbols in the symbol storage area after determining any appropriate awards or award enhancements associated with the storage symbols in the symbol storage area regardless of whether the storage symbols were associated with winning conditions.

In some embodiments, the symbol storage area includes a plurality of symbol display areas arranged in a geometric shape. In some embodiments, the geometric shape is a pyramid. In some embodiments using the pyramid, the gaming system fills the entire pyramid with storage symbols before evaluating these storage symbols for winning conditions (e.g., an evaluation for winning conditions may determine whether a predetermined quantity of a particular storage symbol was stored in the symbol storage area). In some such embodiments, the gaming system determines a first award if the geometric shape is filled with a first predetermined quantity of storage symbols; determines a second award if the geometric shape is filled with a second predetermined quantity of storage symbols; and determines a third award if the geometric shape is filled with a third predetermined quantity of storage symbols. In some embodiments, at least two of the first award, second award, and third award are different. In some embodiments, all of the first, second, and third awards are different. In some embodiments, the first award may be a mini award (or the smallest award of the three), the second award may be a minor award (an award that is larger than the first award, but smaller than the third award), and the third award may be a major award (or an award larger than the first and second awards). It should be appreciated that any suitable quantity of different awards can be associated with different quantities of storage symbols collected in the symbol storage area. In some embodiments, the geometric shape is a rectangle or a square, where the plurality of symbol display areas form a plurality of columns and rows of symbol display areas. It should be appreciated that any suitable shape can be used for the geometric shape.

In some embodiments, the gaming system may randomly generate a plurality of game symbols for a game set of symbol display areas and a plurality of accumulator symbols for an accumulator set of symbol display areas, where the accumulator set of symbol display areas are associated with the game set of symbol display areas. The gaming system may evaluate, generate, and issue any awards associated with winning symbol combinations based on the generated plurality of game symbols. The gaming system may also display, on a display device, the generated plurality of game symbols in the game set of symbol display areas and the generated plurality of accumulator symbols in the accumulator set of symbol display areas. The gaming system determines if any of the generated plurality of game symbols is a match with any of the generated plurality of accumulator symbols. If the gaming system determines that a match exists between a generated game symbol and an accumulator symbol, the gaming system generates a storage symbol and stores the storage symbol in a symbol storage area. The gaming system also displays the storage symbol in the symbol storage area. The storage symbol may be a duplicate of the matching generated game symbol and generated accumulator symbol in some embodiments. In some embodiments, the generated storage symbol may be a symbol different from the matching generated game symbol and generated accumulator symbol. In some embodiments, the gaming system may generate a storage symbol for each generated game symbol that matches with a generated accumulator symbol. The generated storage symbols stored in the symbol storage area may remain in symbol storage area for a predetermined quantity of additional plays of the game (e.g., five plays of the game or some other suitable number) or an unlimited quantity of additional plays of the game.

In some embodiments, the gaming system determines if the symbol storage area includes a predetermined quantity of storage symbols. If the gaming system determines that the symbol storage area includes the predetermined quantity of storage symbols, the gaming system evaluates the storage symbols in the storage symbol area to determine if any winning conditions exist associated with the storage symbols in the symbol storage area. For example, the gaming system may determine if a predetermined quantity of a particular symbol is displayed in the symbol storage area and generate an award associated with the predetermined quantity of the particular symbol. The gaming system may perform this determination for all storage symbols in the symbol storage area. If any winning conditions exist, the gaming system determines any appropriate awards or award enhancements associated with the storage symbols in the symbol storage area. In some embodiments, the gaming system may remove all of the storage symbols from the symbol storage area that are associated with winning conditions. The gaming system may keep storage symbols in the symbol storage area that were not associated with any winning conditions. The gaming system may use these remaining or leftover storage symbols to build up a new collection of storage symbols (e.g., to the predetermined quantity of storage symbols) for use in later plays of the game (e.g., for more awards or award enhancements). However, in some embodiments, the gaming system removes all of the storage symbols in the symbol storage area after determining any appropriate awards or award enhancements associated with the storage symbols in the symbol storage area regardless of whether the storage symbols were associated with winning conditions. In some embodiments, the gaming system removes the generated storage symbols from the symbol storage area when the player cashes out of the game or otherwise quits the game.

In some embodiments, the gaming system may enable a second game to be played alongside the game discussed above. For example, in some embodiments, the gaming system may randomly generate a second plurality of game symbols for a second game set of symbol display areas and a second plurality of accumulator symbols for a second accumulator set of symbol display areas, where the second accumulator set of symbol display areas are associated with the second game set of symbol display areas. In some embodiments, the randomly generated second plurality of game symbols and second plurality of accumulator symbols are generated along with the randomly generated plurality of game symbols and plurality of accumulator symbols. The gaming system may evaluate and issue any awards associated with winning symbol combinations based on a combination of the generated second plurality of game symbols. The gaming system may perform the same aforementioned actions for the randomly generated second plurality of game symbols and second plurality of accumulator symbols to generate further storage symbols for the symbol storage area and evaluate the storage symbols for winning conditions and awards or award enhancements. In addition, the gaming system may evaluate and issue any awards associated with winning symbol combinations based on a combination of the generated plurality of game symbols and the generated second plurality of game symbols. In some embodiments, the awards associated with winning symbol combinations based on a combination of the generated plurality of game symbols and the generated second plurality of game symbols is contingent on the gaming system generating a triggering condition (e.g., one or more symbols) or contingent on the player placing an additional wager.

By enabling the player to collect and store storage symbols over multiple plays of a game and combining awards associated with the storage symbols with standard awards (e.g., awards from evaluating the generated game symbols for winning symbol combinations), the gaming system offers players many new ways to obtain game awards and enhances players' excitement for a game. The new potential to improve or earn greater awards creates a greatly improved sense of anticipation for players.

DETAILED DESCRIPTION OF THE INVENTION

Figure 1:
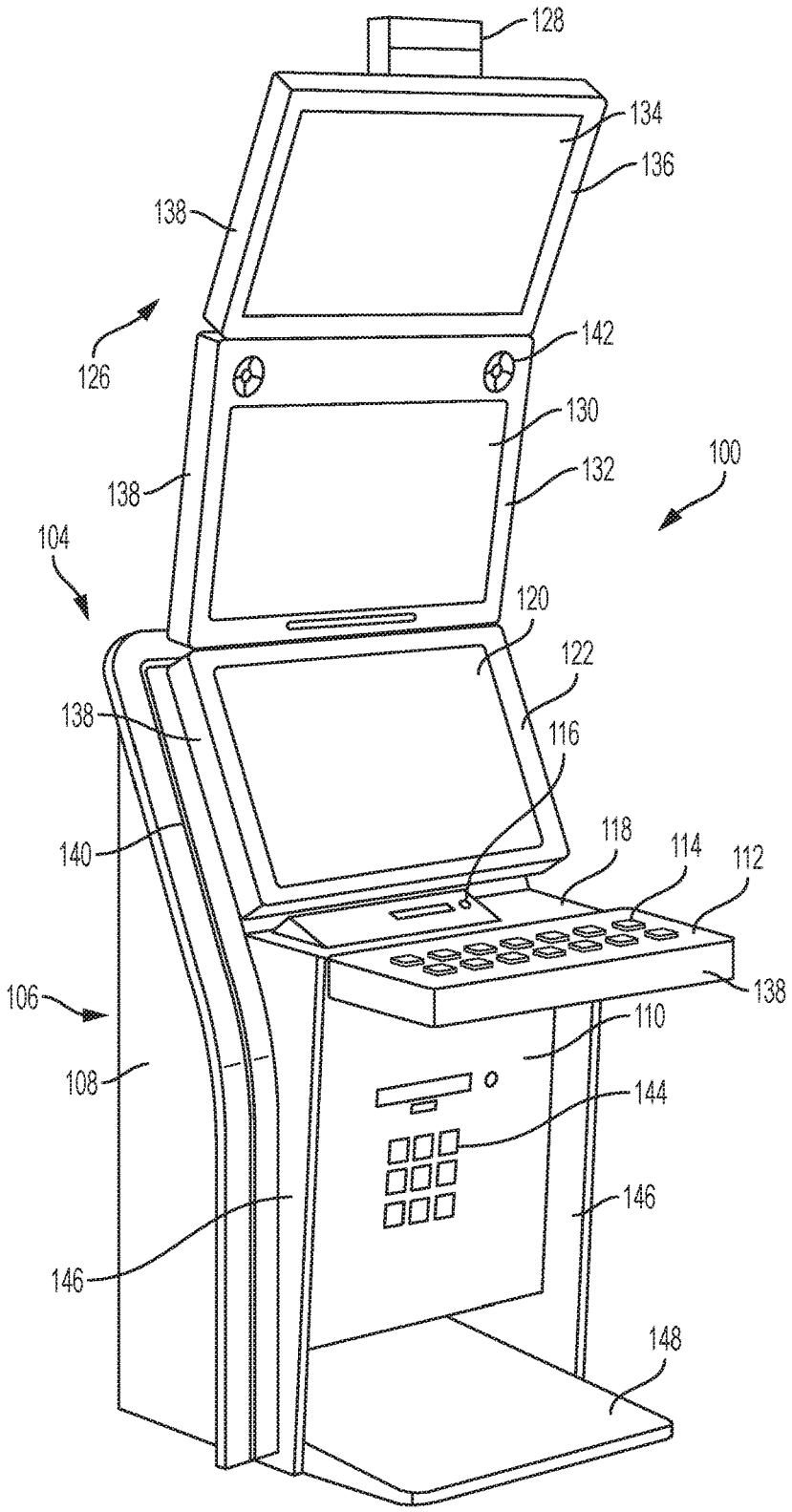
FIG. 1 is a perspective view of one embodiment of a stand-alone gaming device of a gaming system.

Various embodiments of a gaming system and method are disclosed as having awards or award enhancements based on a plurality of storage symbols. In some embodiments, the gaming system enables the plurality of storage symbols to be collected and stored over one or more plays of a game. In some embodiments, the gaming system stores the plurality of storage symbols between plays of a game such that after one play of a game is completed, the stored plurality of storage symbols are available for the next play of the game. In some embodiments, the gaming system collects a wager for at least one or more different plays of the game. In some embodiments, the game played is the same game. In alternative embodiments, the stored storage symbols are available over different plays of different games. In some embodiments, when the gaming system determines that a quantity of stored storage symbols is equal to or greater than a predetermined quantity of storage symbols, the gaming system evaluates the stored plurality of storage symbols for winning conditions. In some embodiments, the gaming system provides one or more awards or award enhancements associated with any determined winning conditions.

In some embodiments of a gaming system and method having awards or award enhancements based on a plurality of storage symbols, the gaming system generates storage symbols based on matches between different sets of symbols. In some embodiments, for a play of a game, the gaming system may generate a storage symbol based on an association between a generated accumulator symbol in a first symbol display area and a generated game symbol in a second symbol display area. The gaming system may collect and store the generated storage symbol so that it is available in at least one next play of the game for evaluating winning conditions and determining awards or award enhancements. The gaming system may store and display the generated storage symbol in a symbol storage area, where the symbol storage area is distinct and apart from the first symbol display area and the second symbol display area. In some embodiments, the gaming system determines if the symbol storage area includes a predetermined quantity of storage symbols.

If the gaming system determines that the symbol storage area includes the predetermined quantity of storage symbols, the gaming system evaluates the storage symbols in the storage symbol area to determine if any winning conditions exist associated with the storage symbols in the symbol storage area. If any winning conditions exist, the gaming system determines any appropriate awards or award enhancements associated with the storage symbols in the symbol storage area. In some embodiments, the gaming system may remove at least one of the storage symbols from the symbol storage area that is associated with a winning condition, but leave storage symbols in the symbol storage area that were not associated with winning conditions. The gaming system may use these remaining or leftover storage symbols to build up a new collection of storage symbols (e.g., to the predetermined quantity of storage symbols) for use in later plays of the game (e.g., for more awards or award enhancements). However, in some embodiments, the gaming system removes all of the storage symbols in the symbol storage area after determining any appropriate awards or award enhancements associated with the storage symbols in the symbol storage area regardless of whether the storage symbols were associated with winning conditions.

In some embodiments, the symbol storage area includes a plurality of symbol display areas arranged in a geometric shape. In some embodiments, the geometric shape is a pyramid. In some embodiments using the pyramid, the gaming system fills the entire pyramid with storage symbols before evaluating these storage symbols for winning conditions (e.g., an evaluation for winning conditions may determine whether a predetermined quantity of a particular storage symbol was stored in the symbol storage area). In some such embodiments, the gaming system determines a first award if the geometric shape is filled with a first predetermined quantity of storage symbols; determines a second award if the geometric shape is filled with a second predetermined quantity of storage symbols; and determines a third award if the geometric shape is filled with a third predetermined quantity of storage symbols. In some embodiments, at least two of the first award, second award, and third award are different. In some embodiments, all of the first, second, and third awards are different. In some embodiments, the first award may be a mini award (or the smallest award of the three), the second award may be a minor award (an award that is larger than the first award, but smaller than the third award), and the third award may be a major award (or an award larger than the first and second awards). It should be appreciated that any suitable quantity of different awards can be associated with different quantities of storage symbols collected in the symbol storage area. In some embodiments, the geometric shape is a rectangle or a square, where the plurality of symbol display areas form a plurality of columns and rows of symbol display areas. It should be appreciated that any suitable shape can be used for the geometric shape.

In some embodiments, the gaming system may randomly generate a plurality of game symbols for a game set of symbol display areas and a plurality of accumulator symbols for an accumulator set of symbol display areas, where the accumulator set of symbol display areas are associated with the game set of symbol display areas. The gaming system may evaluate, generate, and issue any awards associated with winning symbol combinations based on the generated plurality of game symbols. The gaming system may also display, on a display device, the generated plurality of game symbols in the game set of symbol display areas and the generated plurality of accumulator symbols in the accumulator set of symbol display areas. The gaming system determines if any of the generated plurality of game symbols is a match with any of the generated plurality of accumulator symbols. If the gaming system determines that a match exists between a generated game symbol and an accumulator symbol, the gaming system generates a storage symbol and stores the storage symbol in a symbol storage area. The gaming system also displays the storage symbol in the symbol storage area. The storage symbol may be a duplicate of the matching generated game symbol and generated accumulator symbol in some embodiments. In some embodiments, the generated storage symbol may be a symbol different from the matching generated game symbol and generated accumulator symbol. In some embodiments, the gaming system may generate a storage symbol for each generated game symbol that matches with a generated accumulator symbol. The generated storage symbols stored in the symbol storage area may remain in symbol storage area for a predetermined quantity of additional plays of the game (e.g., five plays of the game or some other suitable number) or an unlimited quantity of additional plays of the game.

In some embodiments, the gaming system determines if the symbol storage area includes a predetermined quantity of storage symbols. If the gaming system determines that the symbol storage area includes the predetermined quantity of storage symbols, the gaming system evaluates the storage symbols in the storage symbol area to determine if any winning conditions exist associated with the storage symbols in the symbol storage area. For example, the gaming system may determine if a predetermined quantity of a particular symbol is displayed in the symbol storage area and generate an award associated with the predetermined quantity of the particular symbol. The gaming system may perform this determination for all storage symbols in the symbol storage area. If any winning conditions exist, the gaming system determines any appropriate awards or award enhancements associated with the storage symbols in the symbol storage area. In some embodiments, the gaming system may remove all of the storage symbols from the symbol storage area that are associated with winning conditions. The gaming system may keep storage symbols in the symbol storage area that were not associated with any winning conditions. The gaming system may use these remaining or leftover storage symbols to build up a new collection of storage symbols (e.g., to the predetermined quantity of storage symbols) for use in later plays of the game (e.g., for more awards or award enhancements). However, in some embodiments, the gaming system removes all of the storage symbols in the symbol storage area after determining any appropriate awards or award enhancements associated with the storage symbols in the symbol storage area regardless of whether the storage symbols were associated with winning conditions. In some embodiments, the gaming system removes the generated storage symbols from the symbol storage area when the player cashes out of the game or otherwise quits the game.

In some embodiments, the gaming system may enable a second game to be played alongside the game discussed above. For example, in some embodiments, the gaming system may randomly generate a second plurality of game symbols for a second game set of symbol display areas and a second plurality of accumulator symbols for a second accumulator set of symbol display areas, where the second accumulator set of symbol display areas are associated with the second game set of symbol display areas. In some embodiments, the randomly generated second plurality of game symbols and second plurality of accumulator symbols are generated along with the randomly generated plurality of game symbols and plurality of accumulator symbols. The gaming system may evaluate and issue any awards associated with winning symbol combinations based on a combination of the generated second plurality of game symbols. The gaming system may perform the same aforementioned actions for the randomly generated second plurality of game symbols and second plurality of accumulator symbols to generate further storage symbols for the symbol storage area and evaluate the storage symbols for winning conditions and awards or award enhancements. In addition, the gaming system may evaluate and issue any awards associated with winning symbol combinations based on a combination of the generated plurality of game symbols and the generated second plurality of game symbols. In some embodiments, the awards associated with winning symbol combinations based on a combination of the generated plurality of game symbols and the generated second plurality of game symbols is contingent on the gaming system generating a triggering condition (e.g., one or more symbols) or contingent on the player placing an additional wager.

Gaming Device Platform

The features and advantages of the gaming system and method described herein may be provided to a player via a gaming device platform that includes various structures and components for allowing player interaction with the gaming device. While only one gaming device platform will be described in detail herein, the features, objects, and advantages of the gaming system described herein may be implemented in one or more alternative gaming device platforms.

One embodiment of a gaming device platform is shown in FIG. 1 where a gaming device 100 is generally shown. In one embodiment, the gaming device 100 is referred to as a slot machine and is illustrated as housed in a housing or cabinet constructed so that a player can operate and play the gaming device 100 while standing or sitting.

Gaming device 100 may include cabinet 104 for housing the components fully described hereinbelow. The cabinet 104 has a lower cabinet body portion 106 which includes a pair of cabinet side panels 108 (only one of which is viewable in the perspective view of FIG. 1), front panel 110, and a rear panel (not shown). A base panel (not shown) and a top panel surface (not shown) that supports first game display 120 and the player interaction area 112, are provided. The cabinet panels are interconnected along their edges and cooperate to form a cabinet enclosure for housing the gaming device, as can be seen in FIG. 1.

It should be appreciated that a wide variety of cabinet enclosure sizes, shapes, and designs are possible for the gaming device 100. Cabinet 104 may function to securely protect any local control system, technology components, and provide support for game display(s) and player input and output interactions with the gaming device.

Returning to FIG. 1, the gaming device enables the player to interact with the gaming device 100 to direct the wagering and game play activities and preferences. Various forms of player interaction devices and activities will now be described.

Cabinet 104 includes a player interaction area having input and output areas generally designated as 112. The player interaction area 112 may be located on the front top side of cabinet 104 and, as shown, on a panel structure that extends outwardly from the gaming device in a player's direction. Player interaction area 112 may contain a plurality of player input and output structures such as player control button area 114, player value acceptor and dispenser area 116, and player convenience input area 118.

Player control button area 114 includes a plurality of buttons, touch sensitive areas, or both through with which players may interact with the one or more processors of gaming device 100 and direct game play. It is expected that cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in one embodiment, a player's gaming control interactions could be made by either buttons mounted on cabinet 104 or "soft" buttons located on the gaming display and activated by player touch (e.g., touch screen interfaces), or a combination of both arrangements.

Player control button area 114 may include, for example: game selection button(s) in any embodiments where more than one game is provided in a single gaming device; gaming denomination value selection button(s) in any embodiments where one or more wagering denomination value is accommodated; wager selection button(s) for the player to indicate or select the desired wager value for a game in any embodiments where a selection of wager values are offered; pay line selection button(s) for selecting the number of active pay lines in game embodiments that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information. As discussed above, the functions of the buttons in player control button area 114 may be duplicated with soft buttons in the player control button area 114 or as soft buttons in other areas of the gaming device 100 (e.g., as a touch screen overlay over available game displays).

Gaming device 100 may include one or more forms of value acceptance and value distribution to allow the player to interact with the device and to risk or otherwise place a wager (a monetary value) on one or more outcomes of a game. Winnings may be returned to the player via some form of value distribution. As illustrated in FIG. 1, player value acceptor and dispenser area 116 is provided. In the player value acceptor and dispenser area 116, a player supplies monetary value to the gaming device 100 via one or more value acceptor devices. In one embodiment, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device includes a ticket acceptor as a value acceptor device for receiving tickets or vouchers representing some monetary value. The ticket acceptor may include a bar code reader, or other appropriate code reader, for reading the encoded value contained by the player's ticket or voucher. In some embodiments, the player value acceptor and dispenser area 116 may include a value acceptor device that can accept more than one type of value. In some embodiments, the player value acceptor and dispenser area 116 may include multiple different value acceptor devices to accept different types of value from players Upon receipt of some type of value from the player, a value acceptor device of the player value acceptor and dispenser area 116 performs validation on the player supplied value using appropriate hardware readers (e.g., determining that the currency bills/coins/tokens are genuine or the ticket/voucher is genuine). If the validation result is positive on player supplied value, the appropriate value acceptor device generates a signal to a processor of the gaming device 100 to establish a gaming credit balance for plays of one or more games on gaming device 100.

In one embodiment, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. Gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other embodiments, hardware for transferring (and receiving) non-traditional currencies to players such as digital currencies (e.g., bitcoin) may be included in gaming device 100.

In an alternative embodiment, gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device may be associated with the player account. It is noted that a numeric or alphanumeric keypad may be provided adjacent to the card reader slot to enable player entry of a personal identification number or the like for secure access to card information.

In one embodiment, a player convenience input area 118 may be included in the gaming device 100, as is shown in FIG. 1. In various embodiments, player convenience input area 118 may have a variety of features and functions depending on the jurisdictional deployment of the gaming device 100. In one embodiment, the player convenience input area 118 will house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into a gaming device during play. These player loyalty/player tracking cards are associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain embodiments, the player convenience input area 118 may include player convenience features such as a pocket for storage that allows players to store their personal items such as a mobile phone. Gaming device 100 may include one or more universal serial bus (USB) ports that enables a player to charge their electronics or connect to services such as the Internet or food service. Further, player convenience input area 118 of gaming device 100 may include buttons to request food or drink service if the gaming device is located in an establishment that has food and drink service. The gaming device 100 may be connected to a local or wide area network such that selection of the requested food or drink service will alert the establishment's hospitality staff to deliver the requested service directly to the gaming device 100.

The layout of the player control button area 114, player value acceptor and dispenser area 116 and the player convenience input area 118 in gaming device 100 may be arranged differently than those disclosed and illustrated herein. The selections and arrangement of input locations on the cabinet 104 may be dependent upon the game buttons, the type of value wagered, and the player conveniences utilized in the deployment configuration of gaming device 100.

With continuing reference to FIG. 1, in one embodiment, lower cabinet body portion 106 includes a first game display 120 mounted atop or flush with the lower cabinet body portion's top panel surface. First game display 120 is, for example, a 27-inch liquid crystal display (LCD) display mounted in a widescreen orientation. However, any suitable display may be used in any suitable orientation. In the illustrated embodiment, the first game display 120 is mounted within and framed by first display frame 122 which is, in turn, mounted upon lower cabinet body portion's top panel surface. In this manner, the first game display 120 is both surrounded and secured within the first display frame 122 and raised above the cabinet's top panel surface. Additional features of the first display frame 122 will be described below. In one embodiment, gaming device 100 may use one first game display 120 and not include additional game displays (not illustrated).

The lower cabinet body portion 106 is further constructed to support upper cabinet portion 126. Upper cabinet portion 126 may be comprised of an upwardly extending support structure (not illustrated) that extends upwardly from the rear side of lower cabinet body portion 106 and is sufficiently strong to support one or more additional game displays.

At the topmost end of the support structure, a cabinet top light 128 may be provided. The cabinet top light 128 is capable of illumination in a variety of colors and is utilized to indicate and communicate gaming device conditions to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In one embodiment, as illustrated in FIG. 1, gaming device 100 includes two additional displays, second game display 130 and third game display 134. Second game display 130 and third game display 134 are disposed generally in a vertical relationship and generally in alignment with the first game display 120. Like the first game display 120, second game display 130 and third game display 134 can be 27-inch LCD displays and can be mounted in a widescreen orientation in one embodiment. However, any suitable display in any suitable orientation may be used for the second game display 130 and the third game display 134. Further, like the first game display 120, second game display 130 and third game display 134 can be mounted within and framed by second display frame 132 and third display frame 136, respectively. Second display frame 132 and third display frame 136 are attached to the upper cabinet support structure and can protect the second game display 130 and the third game display 134.

First game display 120, second game display 130, and third game display 134 can be disposed at an angle from each other to form a player-facing concave arc. However, in some embodiments, the angles between the displays may be adjustable and may be smaller or greater than the angles illustrated in FIG. 1. Further, it is understood that in some embodiments the displays may be disposed in a common plane relative to each other.

It also should be appreciated that in various embodiments a variety of display technology may be utilized equivalently and interchangeably with a variety of embodiments of the gaming device. Equivalent display devices include all variations of liquid crystal displays, light emitting diode displays, and plasma displays.

In some embodiments, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative embodiments, one, two, three, or more displays could be used in a variety of positions and orientations. Any suitable combination may be used. It should also be appreciated that a processor of gaming device 100 may communicate with the disclosed first game display 120, second game display 130, and third game display 134 through a video card of gaming device 100 to produce the visible aspects of a game.

In one embodiment, one or more of the first game display 120, second game display 130, and third game display 134 may be fitted with a transparent touch sensitive overlay for sensing player touch inputs into the gaming device. Touch sensitive overlays can communicate with a processor of gaming device 100 to enable the player to interact with the game.

In some embodiments, the curved displays may be used for any or all of the first game display 120, second game display 130, or third game display 134. Similarly, any of the displays used for gaming device 100 can be based on flexible display technologies. For example, it is possible to utilize flexible display technologies to create uniquely shaped curving, wavy, or tubular display structures to provide one or more of the first game display 120, second game display 130, and third game display 134. Additionally, in one embodiment flexible display technologies can be used in combination with fixed flat screen technologies.

While the gaming device 100 has been described as implemented with video technologies, in one embodiment, mechanical reels with reel strips containing game indicia and step motor controllers may be employed to provide game information to a player. In one embodiment, the reel strips may include a plurality of printed symbols. In another embodiment, the mechanical reels may include flexible video display technology as the reel strips on mechanical reels. Thus, games implemented in video form can readily be implemented with mechanical reels utilizing such display technology. Alternatively, in other embodiments mechanical reels with reels strips having fixed symbols displayed along the reel strip could be used to implement the game.

Dependent upon the particular gaming device housing style, a variety of other display technologies may be utilized in combination with the gaming device disclosed herein. For example, in some embodiments a gaming device may have one or more display devices in addition to the main game display(s). For example, the gaming device may include a player tracking device having a player tracking display which displays various information to the player regarding the player's status. The gaming device may also include other game-related displays such as the wager display and the gaming credit balance display. These additional game-related displays may be separate display devices or may be displayed on any one or more of the first game display 120, the second game display 130, or the third game display 134.

Cabinet lighting design functions to attract players to a gaming device 100. In the embodiment of FIG. 1, attractive cabinet lighting is provided by frame accent lighting 138. It is noted that frame accent lighting 138 is a common structure found on each of the first display frame 122, the second display frame 132, and the third display frame 136 and player interaction area 112. Example areas where frame accent lighting is applied to gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In one embodiment, the circuit boards are flexible circuit boards. These LED strips and transparent or translucent coverings may surround one or more gaming device displays frames, as well as the player interaction area, to highlight these areas.

In one embodiment, the individual LEDs mounted on the LED strips are of a type that can emit red, green, and blue light. In an alternative embodiment, separate LEDs are used for each required light color. All LED strips can be electrically connected and can be controlled by a cabinet lighting controller 218 (illustrated in FIG. 2) in conjunction with a processor of gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some embodiments, cabinet 104 may include LED strip lighting or LED rope lighting to accentuate the cabinet and enhance the attractiveness of gaming device 100 to players. LED rope lighting is a plurality of small light-emitting diode bulbs linked together and encased in a plastic, polyvinylchloride, or other suitable material to create a string of lights. For example, in the embodiment of FIG. 1, cabinet 104 includes cabinet accent lighting 140. In one embodiment, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various embodiments, gaming device 100 includes one or more audio speakers and appropriate driving electronics and sound cards so that game players may experience pleasing audio aspects of the gaming device 100. Audio is desirable to attract and maintain player interest in gaming device 100. Gaming device 100 may also emit attraction sounds during any idle period of gaming device 100. Game audio may add to the player's enjoyment of gaming device 100 by providing music and sound effects designed to enhance and compliment the gaming experience.

Audio speaker hardware may include one or more speakers disposed in or on the cabinet 104 of gaming device 100. In FIG. 1, a pair of audio speakers 142 are shown mounted on the upper corners of second display frame 132. Any suitable number of additional speakers may be provided on additional display frames or on the lower cabinet body portion 106 as desired.

Speakers designed for emitting bass vibrations may be included in some embodiments. Speaker placement may be selected to enhance the sound emitting characteristics of the gaming device. For example, bass speakers or additional speakers 144 may be mounted inside lower cabinet body portion 106. Further, it is envisioned that in some embodiments sound processing such as multichannel processing and surround sound processing are included in gaming device 100. Audio jacks for attachment of player headphones may also be provided in some embodiments of gaming device 100 for the player to further enhance the audio experience of the game and also to block out noise from other gaming devices.

In one embodiment, front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing gaming device 100 in a seated position. Foot rest 148, which may be cushioned, is provided below player interaction area 112 to enhance a player's ergonomic comfort while playing gaming device 100. In one embodiment, the edges of player interaction area 112 may be ergonomically cushioned as well.

Gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary 3) provide an easy location and support for all necessary player input/output (I/O) interactions, including gaming control interactions and value wagering interactions. For example, in some embodiments the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In one embodiment, housing styles of cabinet 104 of gaming device 100 may include bar top or table top housing arrangements. These housings are generally small enough to be placed on top of an existing bar or table while providing the requisite gaming device housing functions of protection of/access to gaming electronics, displays, and player I/O functions described above.

In one embodiment, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
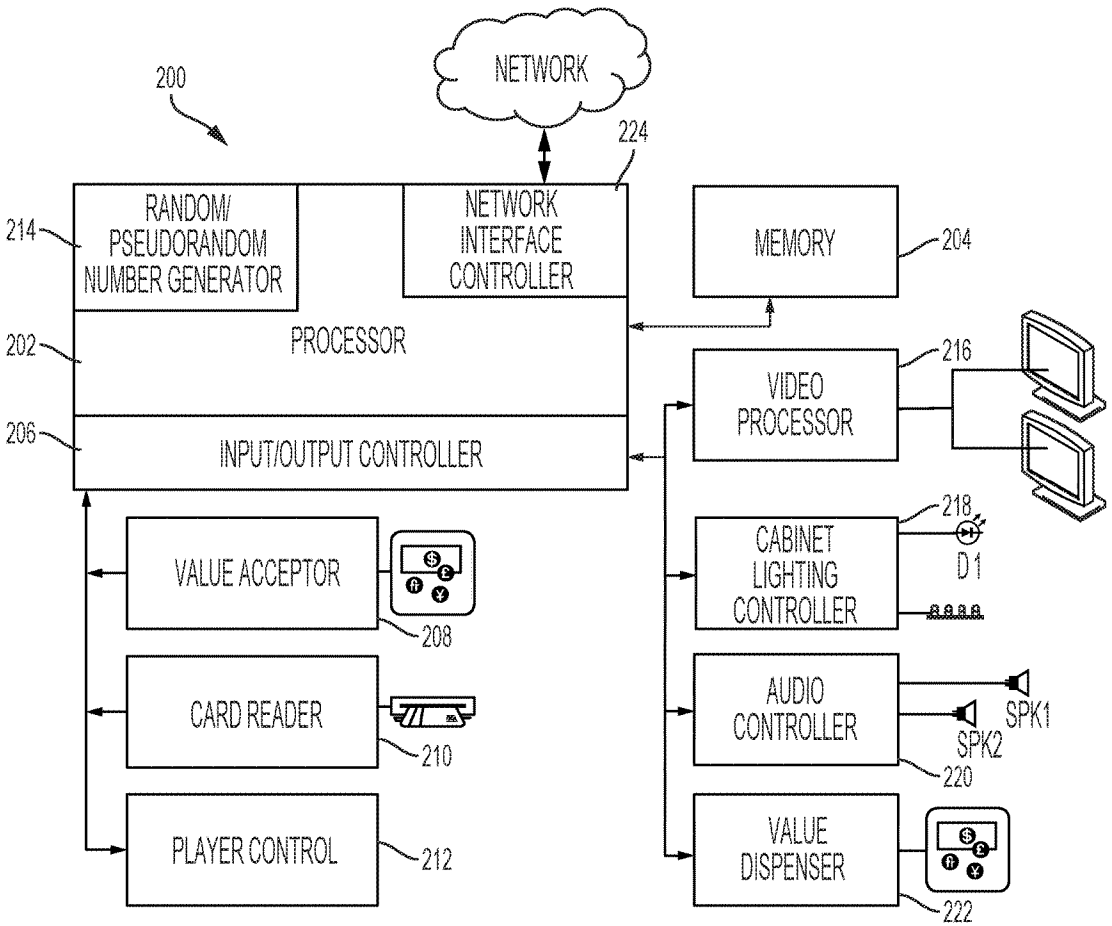
FIG. 2 is a functional block diagram of the gaming device technology components of the gaming system.

Turning now to FIG. 2, the features and advantages of the gaming system described above will now be described in terms of the various technology components for allowing player interaction with the gaming device 100.

FIG. 2 illustrates a functional block diagram of an embodiment of technology components of gaming device 100 that are specially configured to carry out the game function and operations described herein. The functional elements shown in FIG. 2 cooperate, on a broad and general level, to function as gaming device 100. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In one embodiment, gaming device 100 is functionally controlled by control unit 200. Control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one embodiment, control unit is also configured to communicate with a server device through a network.

In one embodiment, control unit 200 includes at least one specially configured processor 202 or central processing unit (CPU). In one embodiment, specially configured processor 202 include arithmetic logic units and math co-processors also known as floating point units. In one embodiment, specially configured processor 202 includes registers for holding instructions or other data, and cache memory for storing data for faster operation thereupon. In one embodiment, specially configured processor 202 may be a multi-core processor that includes two or more processors for enhanced performance, more efficient parallel processing, or other advantageous computing functions. In another embodiment, specially configured processor 202 may be one or more processing devices such as microprocessor(s) or integrated circuit(s) and may include one or more controllers. It should be appreciated that in some embodiments, a general purpose processor could be programmed to perform the functions of specially configured processor 202.

A controller, in one embodiment, is a device or a software program that manages or directs the flow of data between two entities. Often, controllers are special purpose circuitry or software that solve a technical communications problem between different technology systems. In one embodiment, a controller functions as an interface between two systems while managing the communications between the systems. In another embodiment, a controller functions as an interface between a processor and a peripheral device and functions to control the peripheral device.

At least one specially configured processor 202 or controller of control unit 200 is specially configured to communicate with at least one memory device, generally shown as memory device 204 in FIG. 2. In one embodiment, memory device 204 includes one or more memory structures for storing instructions and various types of game data. Memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in one embodiment, communication with a memory device by a processor or a controller encompasses the processor or controller accessing the memory device, exchanging data with the memory device, or storing data to the memory device.

Memory device 204 may store all program code and game code (collectively the "code"), and operation data necessary for the operation of the gaming device 100 and execution of the gaming features described hereinbelow. In an alternative embodiment, game code and operation data necessary for the operation of the gaming device 100 may be store in a distributed manner such that some code is stored in memory device 204 and other code is stored remotely from gaming device 100. In one embodiment, the code and operation data necessary for the operation of the gaming device includes, for example, basic input and output function data, instruction fetching data, bus and network communication protocol data, and like data necessary for an operational gaming device 100. In one embodiment, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in one embodiment, the code and operation data for the operation of the gaming device described above may be stored in removable game cartridges or flash drives, a compact disk ROM, a digital versatile disk (DVD) optical storage technology, or suitable other fixed non-transitory storage mediums. In another embodiment, part or all of the code and operational data for operation of the gaming device or for execution of the game features may be stored in a remote memory structure and be downloaded to the memory device 204 via a network connection.

In one embodiment, the gaming device 100 may utilize any combination of memory devices such as random access memory devices (RAMs), unalterable memory devices (ROMs), and mass storage devices for securely storing and securely communicating the software components or code that facilitate game play and other functions of the gaming device 100. The memory devices may store software components or code that include various game data and game related control and execution software. In some embodiments, the software components stored in the memory devices may include gaming system initialization software, system basic input and output software, operating system software, value acceptor software, value dispenser software, display image generation software, game symbol set image generation software, game rule execution software, game data set(s), random number generation software, system driver software, system data bus management software, audio generation and speaker driver software, and video generation and display driver software, and any other suitable software routines for operation of the gaming device 100.

In some embodiments, the memory devices, such as memory device 204, with the software components and other data may be secured and authenticated by authentication software stored in an unalterable memory device within the housing of gaming device 100. The gaming device 100 may also include application specific integrated circuits (ASICs) to perform the security and authentication functions. At any appropriate time, such as before each play of a game, at a predetermined interval, upon transfer of any game data or any software components from a mass storage to memory device 204, or upon demand, the gaming device 100 (using a processor such as processor 202 or a separate ASIC) may execute an authentication routine and perform an authentication of any software component or other data of the gaming device 100. In one embodiment, the gaming device software components may be prepared for authentication via creation and storage of an encrypted signature unique to one or more of the software components.

In one embodiment, an encrypted signature may be created by utilizing a hash function on a software component or code to form a message digest (i.e., a hash of the software component) followed by a key encryption of the message digest to form an encrypted signature unique to the software component. In some embodiments, the key encryption may be public key encryption, private key encryption, or any suitable key encryption schema. The encrypted signature may be stored with the gaming device software component, for example, in a mass storage device or an unalterable memory. During a software component authentication, the gaming device 100 executes one or more authentication routines utilizing the same hash function to operate on the software component to compute, or re-create, a new message digest for the software component. The new or re-created message digest may then be compared with a previously created message digest obtained by decrypting the stored encrypted signature. Matching message digests between the new and previously created message digests indicate that the software component is authentic and gaming device 100 may allow game play to proceed. However, when the message digests do not match, the gaming device 100 may determine that the software component under authentication may be corrupted or fraudulent and game play may be halted. It should be appreciated that the gaming device 100 may perform other suitable security and authentication checks on the game data or software components. Such authentication and security devices and functions are unique to gaming and casino industry to minimize or prevent fraud in gaming devices and gaming systems.

For a player to interact with gaming device 100, control unit 200 receives and processes player inputs, and control unit 200 causes processed results to be output or communicated to the player. In one embodiment, player inputs are recognized and processed or directed for processing by input/output (I/O) controller 206. Further, I/O controller 206 may process and direct player outputs for communication to the player. I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for each attached input device and output device. In this manner, specially configured processor 202 is freed from the operational details of the peripheral I/O devices. For example, in one embodiment where an input or output device is changed or upgraded, I/O controller 206 can be changed without changing other gaming system 100 components.

In one embodiment, a player deposits value into gaming device 100 by inserting some form of currency into a value acceptor 208 for game play. Alternatively, a player deposits value into gaming device 100 by inserting an encoded paper ticket into a value acceptor 208 for game play in one embodiment. Value acceptor 208 can be combined with a currency reader and validator, and a code reader for reading value encoded on paper tickets. Value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, each time a player risks a wager on an outcome, specially configured processor 202 processes the wage and determines the amount of credits to debit from the player's credit balance. When a winning outcome is obtained, specially configured processor 202 is configured to determine the amount of credits to add to the player's credit balance.

As previously mentioned with respect to FIG. 1, a variety of value acceptance arrangements are possible. In one embodiment, the value acceptor 208 could include magnetic strip or chip card readers to accept and transfer value. Value acceptor 208 may also be configured to accept and transfer non-traditional currencies such as digital currencies. In these embodiments, I/O controller 206, a specially configured processor 202, or both contain appropriate control instructions to communicate and extract value from the inserted item containing value. In one embodiment, use of a magnetic strip or embedded chip card, for example a bank card, for value insertion requires specially configured processor 202 to communicate, via network interface controller 224 (described below), with devices external to the gaming device 100.

In one embodiment, card reader 210 may be included in gaming device 100 to accept player loyalty cards. For example, card reader 210 can extract account identifying information from the card and utilizes this information to access the associated account information stored remotely via network interface controller 224. In embodiments where player loyalty/player tracking systems are employed, a player's loyalty account and record of gaming activity can be stored in a networked storage location or database. Specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various embodiments, player control 212 receives a player's game inputs and communicates the player's game inputs to specially configured processor 202. The player's game inputs may include, but are not limited to, wager amounts, pay line selections, game control signals, and cash-out signals. The player control 212 may generate signals based on button presses, touch screen activations, or voice control. The player initiated signals are propagated to the specially configured processor 202 by I/O controller 206. Further, the player initiated signals may direct and inform execution of the game instructions stored in memory device 204 and configured to be executed by specially configured processor 202.

In one embodiment, specially configured processor 202 is configured to execute stored program code and instructions which generate random numbers or pseudo-random numbers. In one embodiment, as illustrated in FIG. 2, a random number generator (RNG) 214 is a software module configured to be executed by specially configured processor 202 for the generation of a true random or pseudo-random number. The code for RNG 214 may be stored in memory device 204. RNG 214 generates random numbers for use by the gaming software during game execution. In one embodiment, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various embodiments, once random symbols are selected based upon the random number generated by RNG 214, patterns of symbols are compared to determine wagering outcomes. In an alternative embodiment, gaming device 100 may include a hardware based random number generator that is in communication with specially configured processor 202 to supply random numbers for game generation purposes. The hardware based random number generator may be incorporated into specially configured processor 202 or can be separate from specially configured processor 202. In some embodiments, the random number generator may be located in a central server or a server that is remote from the gaming device 100.

The gaming device 100 may receive the randomly generated values from the central server or remote server.

In yet another embodiment, random generation of "numbers" or symbols may be performed with electro-mechanical components. For example, gaming devices such as gaming device 100 may incorporate a plurality of mechanical reels rotatable about a common axis. A plurality of indicia or symbols may be positioned around the periphery of the plurality of reels. Each of the indicia or symbols on each reel may indicate separate detectable reel stop positions. The reels can be set into a spinning/rotation motion by pulling a lever or pushing a button. In some embodiments, the gaming device 100 can stop the reels by the gaming device 100 actuating, on a random timing basis, a suitable mechanical or electro-mechanical reel brake. When the reels stop rotating, one or more displayed stop positions of each reel is detected. Since the stop positions are each associated with an indicia or symbol, the gaming device can determine whether the combination of stop positions (i.e., translating to a combination of displayed symbols) results in a winning symbol combination.

Returning to FIG. 2, control unit 200 controls the function and output of a plurality of output devices utilized by gaming device 100. In various embodiments, I/O controller 206 serves as an interface unit between specially configured processor 202 and output devices such as video processor 216, cabinet lighting controller 218, audio controller 220, and value dispenser 222.

In one embodiment, video processor 216 communicates with specially configured processor 202 to render all game graphics, video displays, and information on gaming device 100's one or more video display units. In one embodiment, video processor 216 includes one or more processors, controllers, and/or graphics cards for processing the game images, outcomes, and animated displays and coordinating the processed data to be display between, among, or across any or all display devices. In various embodiments, this may include being configured to simulate objects and the movement of objects which represent video reels containing sets of gaming symbols.

It should be appreciated that in certain other embodiments where physical mechanical reels are utilized by the gaming device 100 as a game displays, reel controllers and stepper motors would be provided in lieu of or in addition to video processor 216.

In embodiments which utilize cabinet lighting as described with respect to FIG. 1, a cabinet lighting controller 218 may be utilized to coordinate and control the color and timing of cabinet lighting displays with specially configured processor 202. In certain embodiments which utilize sound design, specially configured processor 202 may utilize audio controller 220 to coordinate and control the sound emissions. In one embodiment, audio controller 220 may include one or more audio processing cards for generating sound and for driving the one, two or more speakers that may be included with gaming device 100.

In various embodiments, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In one embodiment, value dispenser 222 can be controlled to issue the player's credit value using any of the types of value discussed herein. In some embodiments, the player's credit value may be issued to the player via a printed and dispensed encoded paper ticket or token which the player can then exchange at a special purpose kiosk or cashier location for the monetary value encoded into the ticket or token. In some embodiments, the specially configured processor 202 can direct the value dispenser 222 to issue to the player an appropriate amount of coin or bills directly to the player. Additionally, or alternatively, in some embodiments, the player may have the option to electronically direct the credit value to an account associated with the player.

In some embodiments, control unit 200 of gaming device 100 may communicate with one or more devices outside the gaming device 100. For example, gaming device 100 may be connected to a larger gaming network via a local area network (LAN) or a wide area network (WAN). Control unit 200 may communicate with one or more central servers, controllers, or remote devices to execute games, establish credit balances, participate in jackpots, etc. In such embodiments, network communications and connections are accomplished via a network interface controller 224. Network interface controller 224 can be a digital circuit board or card installed in control unit 200 to provide network communications with external devices.

In some embodiments, various additional features and functions are performed by control unit 200. For example, control unit 200 may be specially configured with appropriate software to track all game play events that occur on gaming device 100. In some embodiments, control unit 200 may audit all recorded monetary transactions, including all wager amounts, game outcomes, game winnings, and game payouts that occur through gaming device 100. Further, some embodiments may include security software to assist in protecting the gaming device 100 from tamper or alteration attempts.

Gaming System Operation

Figure 3A:
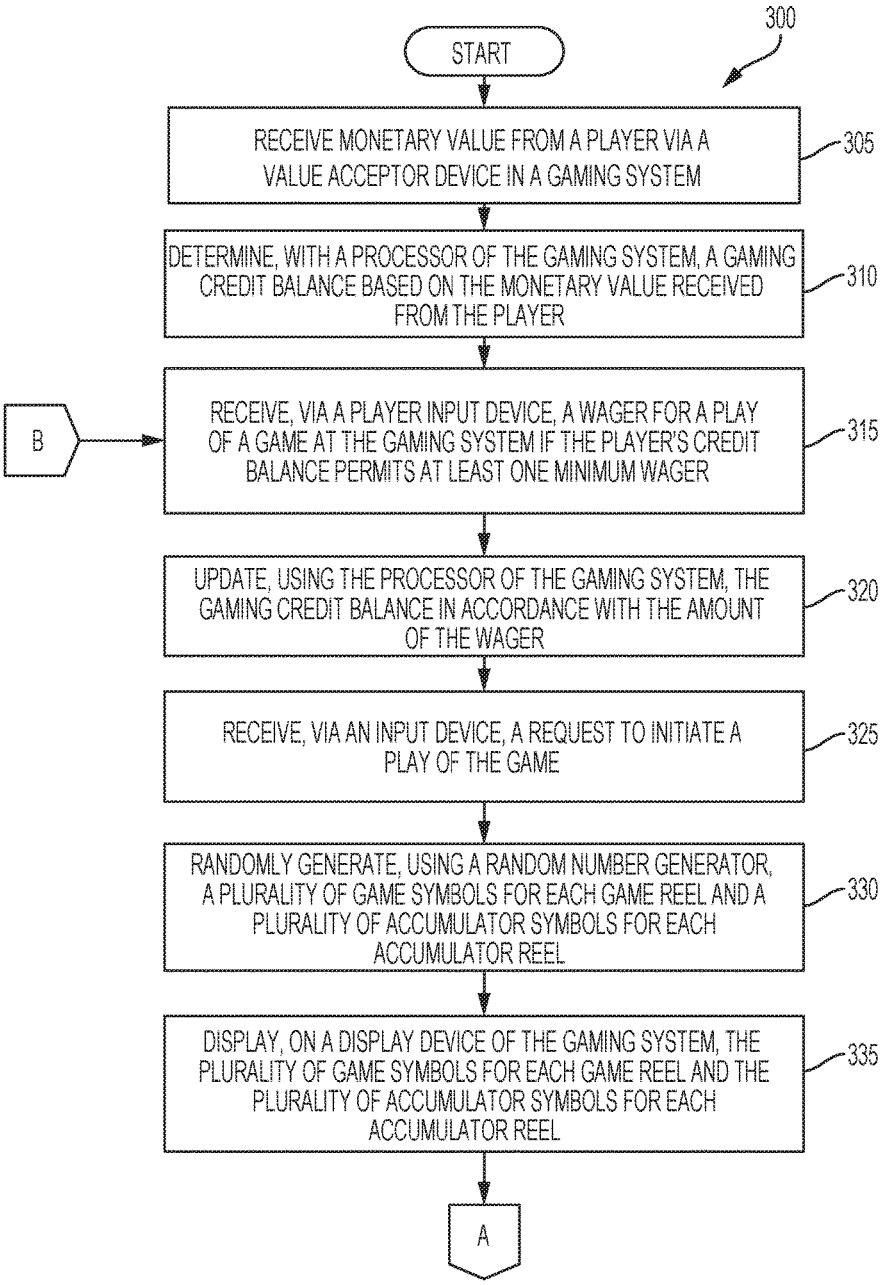
FIGS. 3A, 3B and 3C illustrate one embodiment of a method of operating the gaming system having award enhancements based on storage symbols.
Figure 3B:
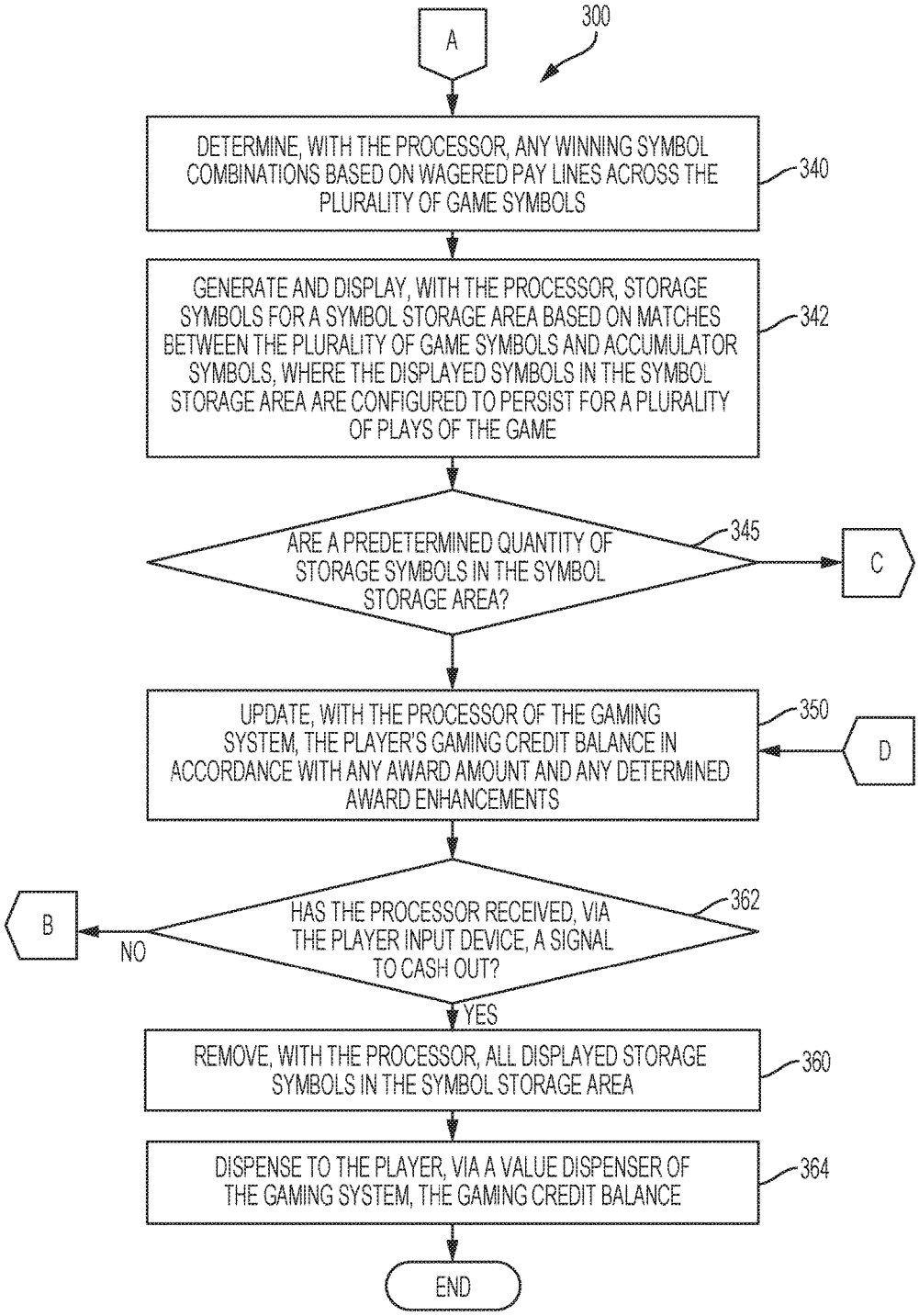
Figure 3C:
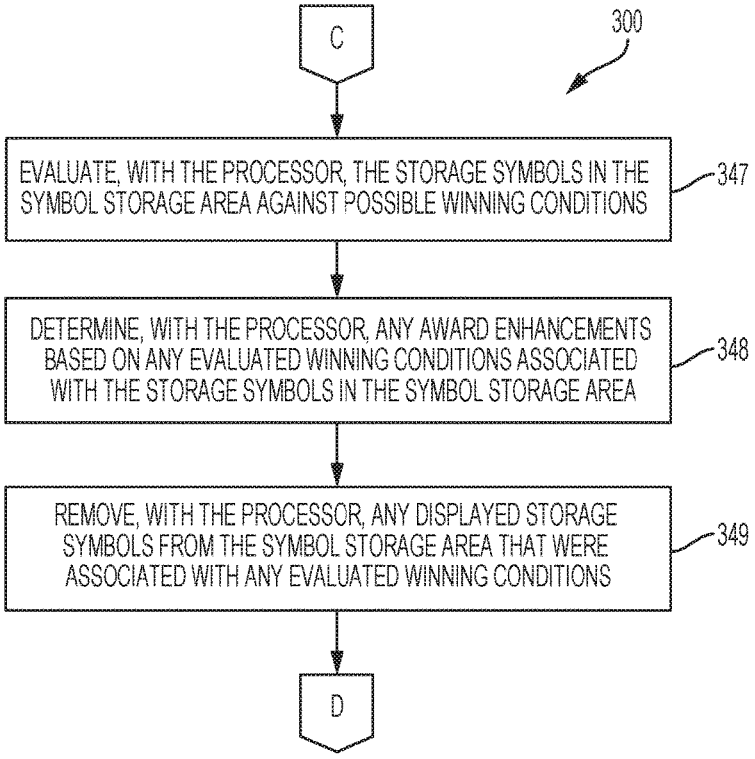

FIGS. 3A, 3B, and 3C illustrate a flowchart of an example operation 300 of one embodiment of the gaming system and method. FIGS. 3A-3C are depicted as a base or primary game. However, it should be appreciated that FIGS. 3A-3C may be integrated as part of a bonus game.

In one embodiment, a processor of the gaming system is configured, via instructions stored in a memory device, to perform the operation 300. However, it should be appreciated that other suitable variations of operation 300 are possible. For example, in one embodiment, fewer or one or more additional blocks (not shown) may be employed in operation 300 of the gaming system and method. In other embodiments, the blocks may be performed in any suitable order.

FIG. 3A illustrates one embodiment in which the gaming system receives a monetary value from a player to initiate operation 300. As indicated in block 305, the gaming system may receive monetary value via a value acceptor device associated with the gaming system. The value acceptor device, in one embodiment, is disposed in a gaming system or in communication with the gaming system as discussed above.

In one embodiment, the gaming system determines a credit balance based on the monetary value received from the player at a value acceptor device as indicated in block 310. The gaming system determines, via a processor, a gaming credit balance for the player. The gaming credit balance may be based on the monetary value received from the player at the value acceptor device.

In one embodiment, the gaming system may receive a wager for a play of a game at the gaming system. Block 315 of FIG. 3A illustrates one embodiment where the player's wager is received via a player input device. The gaming system may allow a player to place a minimum wager, a maximum wager, or any suitable wager amount. Depending on the wager amount, the gaming system may also enable the player to select pay lines across displayed symbol positions (e.g., symbol display areas) on reels in a game in which to place wagers. Although in some embodiments, the gaming system selects the wagered pay lines automatically based on the player's wager. Wagered pay lines may be referred to herein as active pay lines. In one embodiment, the gaming system may determine whether the player provided enough credits to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming system.

In one embodiment, the gaming system may use a processor of the gaming system to update a gaming credit balance. The credit balance may be updated in accordance with the player's wager amount as indicated in block 320. In some embodiments, the credit balance is not updated until a later time.

Block 325 illustrates one embodiment in which the gaming system may receive a request to initiate a play of a game. The request to initiate the play of the game may be received from a player via a player input device in communication with the gaming system. The gaming system may securely access game data from a memory device and execute an authentication routine on the game data to start a play of a game as discussed above. For example, the player may press a spin button on the gaming system to start spinning slot machine reels of the gaming system (or randomly generating symbols using other methods discussed above for virtual reels) for the play of the game. It should be appreciated that reels used throughout the specification may refer to mechanical reels, electro-mechanical reels, or virtual video reels (where virtual reels strips or no reel strips are used). It should further be appreciated that although many examples illustrated in the specification describe the games in terms of slot machines with reels, other games may be used, including games without slot machine reels.

In one embodiment, the gaming system may use a random number generator to randomly generate a plurality of symbols from a plurality of sets of symbols as indicated in block 330. In some embodiments, the gaming system may generate the plurality of symbols for display on a set of reels (or virtual reels). In one embodiment, the gaming system randomly generates a plurality of game symbols for each game reel and a plurality of accumulator symbols for each accumulator reel. In some such embodiments, each reel is associated with its own set of symbols. As used herein, the random number generation may refer to pseudo-random or true-random number generation depending on the module used for the random number generation.

In one embodiment, the gaming system causes a display device of the gaming system to display the plurality of symbols generated as indicated in block 335. In a game using reels, the gaming system may display the generated plurality of game symbols in visible symbol display areas of each of the game reels. In some embodiments, the gaming system has one set of game reels, including a plurality of game reels. In alternative embodiments, the gaming system includes at least two different sets of game reels, where each set includes a plurality of game reels. For example, the gaming system may include a first set of game reels that generate a first type of symbols and a second set of game reels that generate a second type of symbols. The gaming system also displays some of the generated plurality of symbols in visible symbol display areas of one or more accumulator reels. In an embodiment with one set of game reels, the gaming system may generate one accumulator reel that corresponds to the one set of game reels. However, it should be appreciated that the gaming system may generate any suitable number of accumulator reels. In an embodiment with two sets of game reels, the gaming system may generate one accumulator reel for each of the sets of game reels. For example, the first set of game reels is associated with a first accumulator reel while the second set of game reels is associated with a second accumulator reel. Off page connector A refers to FIG. 3B to continue operation 300.

Turning now to FIG. 3B and off page connector A, in one embodiment, as shown in block 340, the gaming system evaluates the plurality of game symbols and determines, with the processor, the existence of any winning symbol combinations based on the player's active or wagered pay lines across the generated plurality of game symbols. In some embodiments, the accumulator symbols on any accumulator reels, which are associated with the game symbols, are not used in the evaluation and determination of any winning symbol combinations of the game symbols. In some embodiments, the accumulator symbols on any accumulator reels, which are associated with the game symbols, can be used in the evaluation and determination of any winning symbol combinations of the game symbols.

In an embodiment with two sets of game reels, the gaming system may perform separate evaluations of the two sets of game reels to determine winning symbol combinations. Thus, in some embodiments, each of the game reel sets can be viewed as a separate game played at the same time within a play of the game. In some embodiments, the gaming system may evaluate both of the separate game reels sets together for winning symbol combinations that are different from winning symbol combinations used to evaluate each game set of reels separately.

In some embodiments, the gaming system evaluates the winning symbol combinations based on the pay lines wagered upon by a player. The gaming system may evaluate the player selected pay lines, gaming system assigned pay lines, or pay lines assigned as active in some other manner for the play of the game. In one embodiment using reels, the gaming system determines an award amount based on winning symbol combinations formed across the reels on active pay lines. For example, if a pay table associated with the gaming system indicated that at least three of the same bar symbols is a winning symbol combination and awards a predetermined payout, the gaming system would evaluate the generated plurality of symbols for bar symbols. If the gaming system generated at least three bar symbols on adjacent reels and along an active pay line, the gaming system may determine that the three bar symbols is a winning symbol combination based on the predetermined pay table. It should be appreciated that a pay table may include any suitable number of winning symbol combinations and payouts. In one embodiment, a pay table may indicate that as few as one symbol may be associated with a payout. Alternatively, two or more symbols may be used to form winning symbol combinations that result in a payout. It should be appreciated that in alternative embodiments, the gaming system evaluates the plurality of game symbols independent of pay lines.

At block 342, the gaming system generates with the processor, storage symbols for a symbol storage area based on matches between the generated plurality of game symbols and accumulator symbols, where the storage symbols are configured to remain stored in the symbol storage area for a predetermined quantity of plays of the game. In some embodiments, the gaming system is configured to keep the storage symbols stored in the symbol storage area for a conditional, unlimited quantity of plays of the game (e.g., as long as the same player plays the gaming system). In one embodiment, rows of an accumulator reel are aligned with rows of the set of game reels. The gaming system may generate symbols for the accumulator reels that are the same as symbols generated for the set of game reels. In such an embodiment, the gaming system compares a generated accumulator symbol in a particular row with symbols generated for the set of game reels in the same row. If the gaming system determines that a generated accumulator symbol matches with a game symbol in the same row of both reels, the gaming system generates a storage symbol for a symbol display position in the symbol storage area. The generated storage symbol is a duplicate of the matching generated accumulator symbol and game symbols in some embodiments. In some embodiments, the generated storage symbol is different from the matching generated accumulator symbol and game symbol. The storage symbols may be displayed apart from the displayed game symbols and accumulator symbols in some embodiments. The storage symbols are used to determine additional awards or award enhancements in some embodiments. In some embodiments, to use the storage symbols to obtain additional awards or award enhancements, the gaming system must collect a predetermined quantity of storage symbols in the symbol storage area. In some embodiments, the gaming system may generate the storage symbols for each generated game symbol on the game reels that matches with accumulator symbols on the accumulator reel.

In some embodiments, the gaming system stores the generated storage symbols in the symbol storage area for a predetermined quantity of next plays of the game (e.g., next spins of the reels). In some embodiments, the predetermined quantity of next plays of the game (e.g., next spins of the reels) is three games. In other embodiments, the predetermined quantity is five games. Any suitable number can be used for the predetermined quantity of games. It should be appreciated that in some embodiments, the predetermined quantity can be randomly generated.

In some embodiments, the gaming system creates a counter for each generated storage symbol to determine how many plays of the game the gaming system will keep the storage symbols for use to create awards or awards enhancements. As the gaming system executes games (e.g., plays of a game), the gaming system alters each counter for each storage symbol to track when the gaming system should remove the storage symbols for a next play of a game.

In alternative embodiments, the gaming system stores the generated storage symbols in the symbol storage area over multiple plays of a game until the player cashes out or otherwise quits the game. In other embodiments, the gaming system stores the generated storage symbols in the symbol storage area over multiple plays of a game even after the player cashes out or otherwise quits the game (e.g., later players can use the stored storage symbols in the symbol storage area to obtain awards or award enhancements based on the store storage symbols).

In some embodiments, the symbol storage area is a geometric shape (e.g., a pyramid, a circle, a square, a rectangle, etc.). The gaming system can be configured to use any suitable shape for the symbol storage area.

In some embodiments, the gaming system may not generate new storage symbols if matches between the generated plurality of game symbols and accumulator symbols are not found.

In some embodiments, the gaming system determines if a predetermined quantity of storage symbols are stored in the symbol storage area as illustrated in block 345. In some embodiments, the predetermined quantity of storage symbols is equal to the quantity of symbol display areas of the symbol storage area (e.g., the gaming system must completely fill the symbol storage area). In other embodiments, the predetermined quantity of storage symbols is some other suitable predetermined or randomly generated quantity of symbols (4, 7, 10, 15, etc.). If the gaming system determines that the predetermined quantity of storage symbols are not stored in the symbol storage area, operation 300 moves to block 350. Block 350 is described more fully below.

If the gaming system determines that the predetermined quantity of storage symbols are stored in the symbol storage area, operation 300 moves to block 347 in FIG. 3C via off-page connector C. In one embodiment, because the gaming system generated enough storage symbols in the symbol storage area, the gaming system evaluates the storage symbols against possible winning conditions. In some embodiments, the winning conditions may be the same or similar to winning symbol combinations used to evaluate the generated game symbols. For example, the winning conditions may include three or more of the same type of storage symbol (e.g., three K symbols) being displayed adjacent to each other in the symbol storage area. In some embodiments, the gaming system evaluates the storage symbols for winning conditions regardless of the adjacencies of storage symbols in symbol display areas. For example, the gaming system may determine if a certain quantity of C symbols are displayed anywhere in the symbol storage area. It should be appreciated that other winning conditions can be used to evaluate the storage symbols in the symbol storage area.

In block 348, the gaming system determines any additional awards or award enhancements based on the storage symbols in the symbol storage area. For example, if the gaming system determined that three C symbols were stored in the symbol storage area, the gaming system may determine that the player won 1000 credits based on an example pay table in FIG. 7. The additional award or award enhancement can be credits, a credit multiplier, or some other suitable award. The additional awards or award enhancements may be defined in a pay table or randomly generated from a set of awards. In some embodiments, the gaming system may provide the player (e.g., add one or more storage symbols to the symbol storage area) when starting an initial play of the game. In other embodiments, the gaming system may enable the player to purchase or place a wager to add one or more storage symbols to the symbol storage area). The gaming system determines, with the processor, a payout amount based on the evaluated winning conditions. In some embodiments, the payout amount may be used to increase or otherwise enhance other existing determined payout awards (e.g., in accordance with any awards obtained in connection with block 340).

As illustrated in block 349, the gaming system may remove, with the processor, any displayed symbols from the symbol storage area that were associated with any evaluated winning conditions in some embodiments. For example, if the plurality of C symbols in the symbol storage area are associated with a winning condition, the gaming system may remove the plurality of C symbols from the symbol storage area after the winning conditions are determined (and the gaming system issues awards associated with the winning conditions). The gaming system may perform the same removal process for any other symbols. However, if no other symbols were associated (or created a winning condition), the gaming system may keep these other symbols in the symbol storage area for at least one or more additional plays of the game in some embodiments. Thus, the removed C symbols are not available for future plays of the game, but other symbols are available for future plays of the game to potentially result in additional awards or award enhancements in some embodiments.

In some embodiments, if a predetermined quantity of the stored storage symbols in the symbol storage area are different from each other and prevent the player from obtaining winning conditions, the gaming system may remove at least one or more of the stored storage symbols to enable the gaming system to generate and collect new (and potentially different) storage symbols. In such a scenario, removing at least one or more symbols that prevent a player from obtaining winning conditions prevents the players from disappointment with the game.

In some embodiments, operation 300 return to FIG. 3B to block 350 via off-page connector D.

As illustrated in block 350, the gaming system may update, with the processor, the player's gaming credit balance in accordance with any award amount (including any additional award or award enhancement). As noted above, the blocks illustrated in FIGS. 3A and 3B can be rearranged in any suitable order. As such, it should be appreciated that the gaming system may update the player's gaming credit balance at other suitable times.

In some embodiments, the gaming system may decrement each counter for each displayed storage symbol in the symbol storage area that was not generated during the current play of the game (not shown). That is, for a play of the game, the gaming system may not alter a counter for newly generated storage symbols, but will alter counters for storage symbols that persisted from a prior play of the game.

In some embodiments, the gaming system may also evaluate the plurality of symbols across wagered pay lines for symbol combinations that trigger a bonus game (not shown) with a predetermined quantity of spins (or activations, where the bonus game does not use slot reels). In some embodiments the symbol or symbol combinations that trigger the bonus game do not need to appear on wagered pay lines. In some embodiments, the predetermined quantity of spins are provided as free spins. In other embodiments, the player may pay to obtain the predetermined quantity of spins. It should also be appreciated that in some embodiments, events other than generating one or more of a predetermined symbol may trigger the bonus game. In one embodiment, if the gaming system determines that the generated plurality of symbols includes one or more generated predetermined symbols, the gaming system will trigger or activate the bonus game. The gaming system may execute the bonus game and return to block 362. The bonus game may be any suitable game. The bonus game may be similar to the game described herein and may be played with free spins, free games, or other altered features. If the gaming system determined that the generated plurality of symbols did not result in triggering a bonus game or the gaming system completed execution of a bonus game, operation 300 moves to block 362. In one embodiment, as indicated in block 362, the gaming system may receive a signal to end game play or "cash out" via an input device of the gaming system.

In some embodiments, the gaming system removes all displayed storage symbols in the symbol storage area when the player cashes out or otherwise ends all game play as the gaming system, as illustrated in block 360. By removing all displayed stored symbols, the gaming system provides a number of benefits to enhance the gaming system. One benefit is that the gaming system uses less memory and reduces the processor load because the stored symbols are removed earlier than was possible if the player continued to play additional games. Using less memory and less processing power reduces the gaming system's power usage, making the gaming system more efficient. Another benefit is that the stored symbols are not left for a next player that uses the gaming system (the next player must attempt to cause the gaming system collect new stored symbols for the next player's gaming session). By not having left over stored storage symbols for a next player of the game, other players are less likely to fight over a gaming system that has persistent stored storage symbols from a prior player. By not having left over stored storage symbols for a next player, the gaming system also avoids potentially altering the theoretical return to player associated with the gaming system (in which wins may have occurred faster than statistically practical when the next player can use the prior player's stored symbols). However, it should be appreciated that the gaming system can be configured to permit the stored storage symbols to remain after a player ends game play or cashes out, in alternative embodiments.

As illustrated in block 364, the gaming system dispenses a value to the player, through a value dispenser, based on the player's gaming credit balance and operation 300 ends.

Returning to block 362, if the gaming system has not received a signal to end game play via the player input device, the process of operation 300 returns to block 315 via off page connector B. The gaming system may receive, via a player input device, a wager for another (e.g., next) play of the game and continue operation 300 from block 315. Any generated storage symbols in the symbol storage area will remain stored in the symbol storage area (and visible) for the next play of the game. However, in one embodiment, the wager may not be accepted if the player has fewer credits than the player's selected wager amount as shown in block 315.

In some embodiments, the gaming system can generate a storage symbol based on any game symbol generated for the game reels. Thus, in some embodiments, the gaming system can generate a storage symbol based on a game symbol such as a bonus triggering symbol. In some embodiments, when the gaming system generates storage symbols that are bonus triggering symbols, the gaming system may evaluate the stored bonus trigging storage symbols as one or more extra triggering symbols that can be combined with certain game symbols to trigger a bonus game.

In some embodiments, storage symbols are provided as part of a standard wager in a game. In alternative embodiments, storage symbols are not free to obtain. For example, in some embodiments, a player must wager at a predetermined minimum level before the gaming system makes the storage symbols available during a play of the game. In some embodiments, once the player obtains a storage symbol, the storage symbol may persist in the symbol storage area for additional plays of the game without maintaining the predetermined minimum wager level. In alternative embodiments, the player must continue to wager at the predetermined minimum level for each play of the game to maintain the persistence of any collected storage symbols in the symbol storage area for additional plays of the game. In some embodiments, when the player has not wagered the predetermined minimum level, the gaming system may still generate and display storage symbols, but the gaming system may not evaluate the storage symbols to determine award enhancements. By displaying the storage symbols that will not result in an award enhancement, the gaming system shows the player what the player would have won if the player has elected to play (e.g., through an appropriate wager) the game with the storage symbols.

In some embodiments, the gaming system includes a second set of game reels and a second accumulator reel. In some embodiments, a player must wager at a predetermined minimum level before the gaming system makes the second set of game reels and the second accumulator reel available for the player during a play of the game. In some embodiments, when the player has not wagered the predetermined minimum level, the gaming system may still generate and display game symbols for the second set of game reels and accumulator symbols for the second accumulator reel (as well as storage symbols for the second set of game reels), but the gaming system may not evaluate the generated symbols for the second set of game reels for awards (or storage symbols on the second set of game reels to determine award enhancements).

In some embodiments including more than one set of game reels, the gaming system evaluates each set of the game reels in different directions. For example, the gaming system may evaluate a first set of game reels from right to left, while the gaming system evaluates a second set of game reels from left to right. In some embodiments, the gaming system may evaluate generated symbols for two or more of the sets of game reels together for winning symbol combinations. In some such embodiments, each set of game reels may be associated with its own pay table for evaluating winning symbol combinations, while the gaming system may be configured to evaluate the combined sets of game reels with another pay table that accounts for certain winning symbol combinations form across the combined sets of game reels.

In some embodiments including more than one set of game reels, the gaming system uses the same symbols for the sets of game reels. In alternative embodiments, one or more of the sets of game reels uses different symbols.

In some embodiments, an accumulator reel is positioned on the left side or the right side of the game reels. In embodiments with two different sets of game reels, where each set of game reels is associated with its own accumulator reel (or accumulator reels), the accumulator reels can be positioned in a center area between the two different sets of game reels.

In some embodiments including more than one set of game reels, all of the sets of game reels are associated with one accumulator reel.

In some embodiments, the gaming system randomly generates a plurality of replacement game symbols for the game set of symbol display areas and a plurality of replacement accumulator symbols for the accumulator set of symbol display areas for the next play of a game. The gaming system may determine if at least one of the generated replacement game symbols matches with at least one of the generated plurality of replacement accumulator symbols. The gaming system may generate additional storage symbols for the storage set of symbol display areas where the processor further determines matches between the generated replacement game symbols and the generated plurality of replacement accumulator symbols. If the gaming system determined that a second quantity of the plurality of storage symbols and the additional storage symbols is equal to or greater than the predetermined quantity of symbols, the gaming system may determine any additional awards based on the plurality of storage symbols.

FIGS. 4A-4D illustrate screen shots of one embodiment of a gaming system having award enhancements based on a plurality of storage symbols. While FIGS. 4A-4D are described in terms of a base game, it should be appreciated that the features discussed in connection with FIGS. 4A-4D can be used in connection with a bonus game.

Figure 4A:
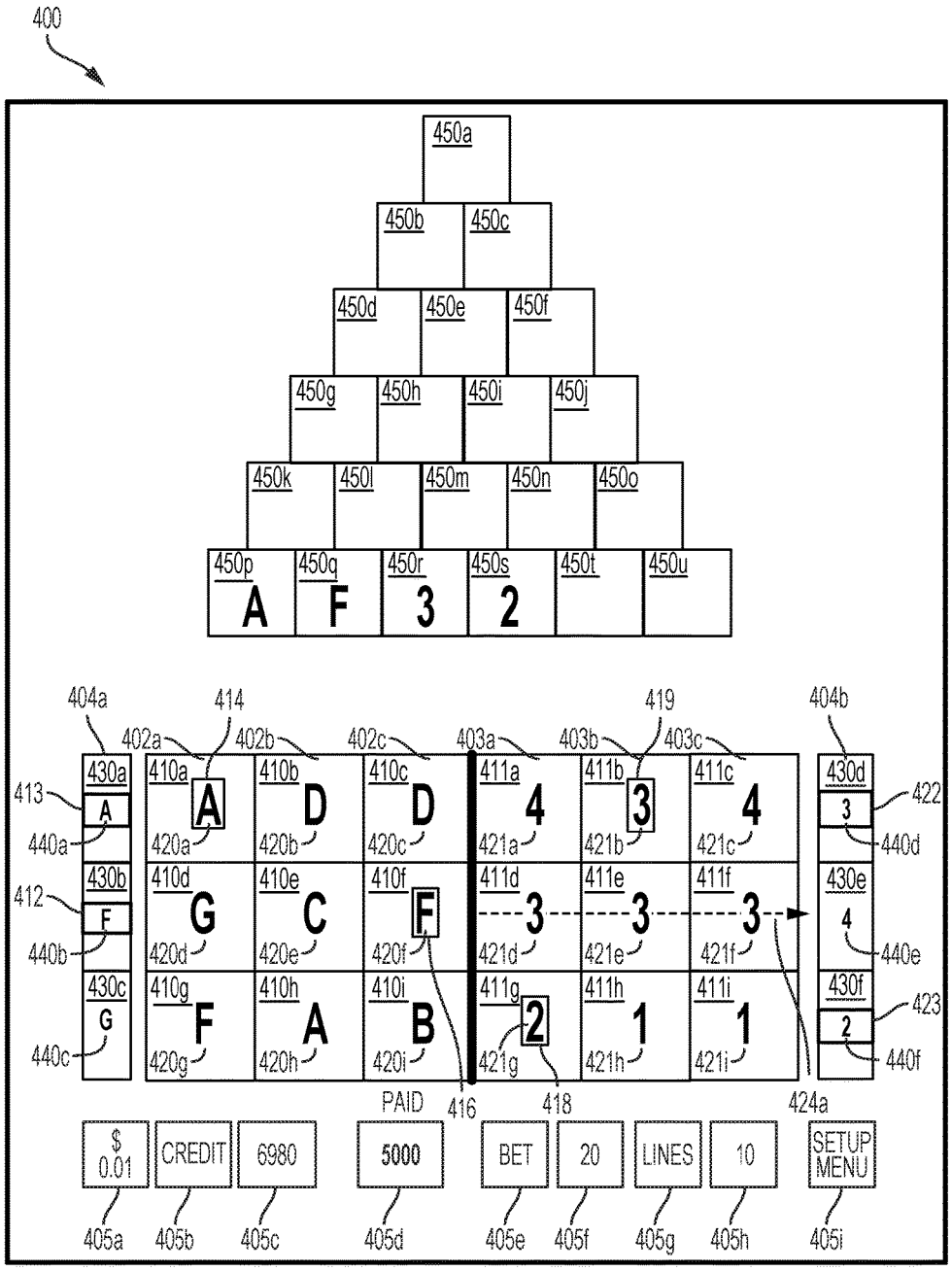
FIGS. 4A, 4B, 4C, and 4D illustrate screen shots of one embodiment of a gaming system having award enhancements based on storage symbols.

FIG. 4A illustrates one embodiment of a game display 400 that the gaming device 100 may display on a display device of the gaming system. In one embodiment, game display 400 may be displayed on first display 120 of gaming device 100 illustrated in FIG. 1. However, any other suitable display may be used. The game display 400 displays a first set of a plurality of virtual video slot machine reels 402*a*, 402*b*, and 402*c* (e.g., a first set of game reels) as illustrated in FIG. 4A for a primary or base game. As also illustrated in FIG. 4A, the reels 402*a*-402*c* are displayed substantially side by side. It should be appreciated that reels 402*a*-402*c* can be displayed with any suitable amount of separation or no separation. FIG. 4A illustrates an accumulator reel 404*a* displayed to the left of the reels 402*a*-402*c*. Accumulator reel 404*a* is associated with the reels 402*a*-402*c* as will be discussed below. Accumulator reel 404*a* can be displayed with any suitable amount of separation or no separation from reels 402*a*-402*c*. In some embodiments, accumulator reel 404*a* can be positioned to the right of reels 402*a*-402*c*. In some embodiments, reels 402*a*-402*c* are separated from reels 403*a*-403*c*, enabling accumulator reel 404*a* to be positioned between such reels 402*a*-402*c* and reels 403*a*-403*c*.

The game display 400 displays a second set of a plurality of virtual video slot machine reels 403*a*, 403*b*, and 403*c* (e.g., a second set of game reels) as illustrated in FIG. 4A for a primary or base game. As also illustrated in FIG. 4A, the reels 403*a*-403*c* are displayed substantially side by side. It should be appreciated that reels 403*a*-403*c* can be displayed with any suitable amount of separation or no separation. FIG. 4A illustrates an accumulator reel 404*b* displayed to the right of the reels 403*a*-403*c*. Accumulator reel 404*b* is associated with the reels 403*a*-403*c* as will be discussed below. Accumulator reel 404*b* can be displayed with any suitable amount of separation or no separation from reels 403*a*-403*c*. In some embodiments, accumulator reel 404*b* can be position to the right of reels 403*a*-403*c*. In some embodiments, reels 403*a*-403*c* are separated from reels 402*a*-402*c*, enabling accumulator reel 404*b* to be positioned between such reels 403*a*-403*c* and reels 402*a*-402*c*. In some embodiments, accumulator reels 404*a* and 404*b* can be positioned between both reels 403*a*-403*c* and reels 402*a*-402*c*.

It should be appreciated that the game shown in game display 400 is merely representative and may have more or fewer game elements (e.g., reels, symbol display areas, symbols, etc.) shown in the game display 400. It should also be appreciated that other games may be used for the primary or base game.

Each of the plurality of game reels 402*a*-402*c*; each of the plurality of game reels 403*a*-403*c*; the accumulator reel 404*a*; and the accumulator 404*b* are associated with their own set of symbols, where each set of symbols includes a plurality of symbols. Each of such sets of symbols can be associated with the same or a different plurality of symbols. The sets of symbols may include numbers, letters, geometric figures, symbols, images, character, blank symbols (e.g., the absence of symbols), animations, transparent symbols (e.g., symbols that permits underlying symbols to be visible), or any other suitable graphical depiction. The symbols in the set of symbols may include pay symbols and special or designated symbols. In one embodiment, at least one predetermined symbol is a triggering symbol for a bonus game. In one embodiment, at least one triggering symbol must be generated on the reels during a play of a game to trigger the bonus game. In some embodiments, a plurality of triggering symbols must be generated on the reels during a play of a game to trigger the bonus game. In one embodiment, any one of the symbols in the sets of symbols can be designated as the predetermined triggering symbol. The triggering symbol may be associated with one function (e.g., triggering a bonus game), but may alternatively be associated with a plurality of different game functions. The triggering symbol may be a scatter symbol in some embodiments.

In the embodiments illustrated in FIG. 4A-4D, the first set of game reels 402*a*-402*c* and accumulator reel 404*a* use the same symbols in their respective symbol sets while the second set of game reels 403*a*-403*c* and accumulator reel 404*b* use the same symbols in their respective symbol sets. As illustrated, in FIG. 4A-4D, the symbols used for the first set of game reels 402*a*-402*c* and accumulator reel 404*a* in their respective symbol sets are different from the symbols used for the second set of game reels 403*a*-403*c* and accumulator reel 404*b* in their respective symbol sets. However, in alternative embodiments, the symbols can be the same between the different reel sets.

Returning now to FIG. 4A, the game display 400 depicts a plurality of symbol display areas (also referred to herein as symbol display positions) 410*a*, 410*b*, 410*c*, 410*d*, 410*e*, 410*f*, 410*g*, 410*h*, and 410*i*. These plurality of symbol display areas can be associated in a manner that provides the appearance of game reels. It should also be appreciated that the symbol display areas may not be associated with game reels in some embodiments. As illustrated in FIG. 4A, symbol display areas 410*a*, 410*b*, 410*c*, 410*d*, 410*e*, 410*f*, 410*g*, 410*h*, and 410*i* are associated in a manner that provides the appearance of a set of three game reels for a slot machine. In one embodiment, the plurality of symbol display areas that provide the appearance of three game reels may be arranged in a manner that visibly shows three symbol positions of each of the three game reels. For example, the symbol display areas 410*a*-410*i* are each associated with positions on reels 402*a*-402*c*, respectively (as described herein as game reels 402*a*-402*c*). As shown in FIG. 4A, symbol display areas 410*a*, 410*d*, and 410*g* are associated with reel 402*a*; symbol display areas 410*b*, 410*e*, and 410*h* are associated with reel 402*b*; and symbol display areas 410*c*, 410*f*, and 410*i* are associated with reel 402*c*. The arrangement illustrated in the embodiment of FIG. 4A thus creates a visible display area of the reels 402*a*-402*c* comprising three visible symbol positions for each reel. When viewed together, reels 402*a*-402*c* appear like a 3-row by 3-column reel array in display 400. In other embodiments, smaller or larger visible areas of the reels can be displayed. That is, the reels 402*a*-402*c* may show fewer or a larger number of visible symbol display areas. Associated accumulator reel 404*a* also depicts a plurality of symbol display areas 430*a*, 430*b*, and 430*c*. The accumulator reel 404*a* is associated with symbol display areas 410*a*-410*i* because symbols generated on the accumulator reel 404*a* are evaluated together with symbols generated for symbol display areas 410*a*-410*i* to create storage symbols. These plurality of symbol display areas can be associated in a manner that provides the appearance of a reel. It should also be appreciated that the symbol display areas may not be associated with reels in some embodiments. As illustrated in FIG. 4A, symbol display areas 430*a*, 430*b*, and 430*c* are associated in a manner that provides the appearance of one reel (an accumulator reel) for a slot machine. In one embodiment, the plurality of symbol display areas that provide the appearance of one reel may be arranged in a manner that visibly shows three symbol positions in the one reel. For example, the symbol display areas 430*a*-430*c* are each associated with positions on the reel 404*a*.

The game display 400 also depicts a plurality of symbol display areas (also referred to herein as symbol display positions) 411*a*, 411*b*, 411*c*, 411*d*, 411*e*, 411*f*, 411*g*, 411*h*, and 411*i*. These plurality of symbol display areas can be associated in a manner that provides the appearance of game reels. It should also be appreciated that the symbol display areas may not be associated with game reels in some embodiments. As illustrated in FIG. 4A, symbol display areas 411*a*, 411*b*, 411*c*, 411*d*, 411*e*, 411*f*, 411*g*, 411*h*, and 411*i* are associated in a manner that provides the appearance of a set of three game reels for a slot machine. In one embodiment, the plurality of symbol display areas that provide the appearance of three game reels may be arranged in a manner that visibly shows three symbol positions of each of the three game reels. For example, the symbol display areas 411*a*-411*i* are each associated with positions on reels 403*a*-403*c*, respectively (as described herein as game reels 403*a*-403*c*). As shown in FIG. 4A, symbol display areas 411*a*, 411*d*, and 411*g* are associated with reel 403*a*; symbol display areas 411*b*, 411*e*, and 411*h* are associated with reel 403*b*; and symbol display areas 411*c*, 411*f*, and 411*i* are associated with reel 403*c*. The arrangement illustrated in the embodiment of FIG. 4A thus creates a visible display area of the reels 403*a*-403*c* comprising three visible symbol positions for each reel. When viewed together, reels 403*a*-403*c* appear like a 3-row by 3-column reel array in display 400. In other embodiments, smaller or larger visible areas of the reels can be displayed. That is, the reels 403*a*-403*c* may show fewer or a larger number of visible symbol display areas. Associated accumulator reel 404*b* also depicts a plurality of symbol display areas 430*d*, 430*e*, and 430*f*. The accumulator reel 404*b* is associated with symbol display areas 411*a*-411*i* because symbols generated on the accumulator reel 404*b* are evaluated together with symbols generated for symbol display areas 411*a*-411*i* to create storage symbols. These plurality of symbol display areas can be associated in a manner that provides the appearance of a reel. It should also be appreciated that the symbol display areas may not be associated with reels in some embodiments. As illustrated in FIG. 4A, symbol display areas 430*d*, 430*e*, and 430*f* are associated in a manner that provides the appearance of one reel (another accumulator reel) for a slot machine. In one embodiment, the plurality of symbol display areas that provide the appearance of one reel may be arranged in a manner that visibly shows three symbol positions in the one reel. For example, the symbol display areas 430*d*-430*f* are each associated with positions on the reel 404*b*.

While symbol display areas are illustrated with defined boxes in FIGS. 4A-4D, it should be appreciated that in some embodiments, the defined boxes are not visible to the player. It should also be appreciated that in some embodiments, the symbol display areas are other shapes or not defined shapes and may not be associated with reels.

Each set of game reels 402*a*-402*c* and 403*a*-403*c* and accumulator reels 404*a* and 404*b* may display a plurality of symbols that the gaming system generates from their respective sets of symbols in their respective symbol display areas as illustrated in FIG. 4A. In one embodiment, the reels may be shown spinning in one direction to simulate slot machine reels. However, it should be appreciated that the reels may be shown spinning in any suitable direction. The reels may also be shown spinning in different directions in some embodiments.

The game display 400 also depicts a plurality of symbol display areas (also referred to herein as symbol display positions) 450*a*, 450*b*, 450*c*, 450*d*, 450*e*, 450*f*, 450*g*, 450*h*, 450*i*, 450*j*, 450*k*, 450*l*, 450*m*, 450*n*, 450*o*, 450*p*, 450*q*, 450*r*, 450*s*, 450*t*, and 450*u*. These plurality of symbol display areas can be organized and displayed as a geometric shape. As illustrated in FIG. 4A, the geometric shape is a pyramid. It should also be appreciated that the symbol display areas 450*a*-450*u* can be organized and displayed in any suitable shape. In some embodiments, the symbol display areas 450*a*-450*u* are not organized and displayed in a geometric shape (e.g., the symbol display areas 450*a*-450*u* are separated or can be displayed dispersed throughout the game display 400 or other game displays). In some embodiments, symbol display areas 450*a*-450*u* form a symbol storage area for collecting and storing storage symbols. In some embodiments, the symbol storage area may show fewer or a larger number of visible symbol display areas. As the gaming system generates storage symbols based on the game reels and accumulator reels, the gaming system places the generated storage symbols in the symbol display areas 450*a*-450*u*. The gaming system is configured to keep at least some of the generated and displayed storage symbols in the symbol storage area for multiple different plays of a game or even for multiple different plays of different games.

The gaming system may populate the symbol storage area with generated storage symbols in various different ways. In some embodiments, the gaming system populates the storage symbols in the symbol storage area from the bottom to the top. In alternative embodiments, the gaming system populates the storage symbols in the symbol storage area from the top to the bottom. It should be appreciated that the gaming system may populate the storage symbols in the symbol storage area in any suitable manner (left to right, random placement, etc.). In some embodiments, the gaming system populates the generated storage symbols in the symbol storage area starting from the bottom row and places the symbols in the symbol storage area as they are generated from left to right. In some embodiments, the gaming system may designate certain rows or certain columns (when applicable) of the symbol storage area for certain generated storage symbols. For example, a bottom row of the symbol storage area can be designated as a row for A symbols. Another row of the symbol storage area can be designated for 3 symbols. In such an embodiment, the gaming system therefore may restrict what symbols from the game reels and accumulator reels can become storage symbols. In some embodiments, the gaming system designates the rows of symbol display areas in a first available manner. For example, if the gaming system first generates an A storage symbol, the gaming system can designate the bottom row of the symbol storage area (e.g., 450*p*-450*u*) for the A storage symbols. If the gaming system generates a 5 storage symbol, the gaming system may designated the next row up (e.g., 450*k*-450*o*) for 5 storage symbols. At least one other embodiment of how a gaming system can populate a symbol storage area is discussed below in connection with FIG. 5.

Game display 400 also includes several information areas and buttons 405*a*-405*i*. These information areas and buttons 405*a*-405*i* are illustrated in a particular arrangement, but may be arranged in any suitable manner in different embodiments. In some embodiments, game display 400 may include more or fewer display areas and buttons 405*a*-405*i* than illustrated. Information area 405*a* illustrates an example value of one credit for the game displayed in game display 400. Information areas 405*b* and 405*c* illustrate an example of the amount of the player's available credits. Information area 405*d* illustrates the amount of credits a player has won. Because FIG. 4A illustrates the end of one play of the game, the information area 405*d* shows 5000 credits have been won (which will be explained further below). Button 405*e* illustrates a software button that the player can select to place a bet or wager. It should be appreciated that the functionality of button 405*e* may also be replicated or replaced with a hardware button on the gaming device 100. Information area 405*f* illustrates that the player has selected to wager 200 credits by selecting to wager 20 credits on 10 pay lines. Button 405*g* illustrates a software button that the player can select to determine how many pay lines to wager on. It should be appreciated that the functionality of button 405*g* may also be replicated or replaced with a hardware button on the gaming device 100. Information area 405*h* illustrates that the player selected to wager on 10 pay lines. Button 405*i* illustrates a software button that the player can select to obtain information about the game, change certain aspects of the game, obtain help, place an order, etc.

To start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on a play of the game. The gaming system may provide a visual indication of the player's credit balance to the player as discussed above in information area 405*c*. As previously discussed, in some embodiments, the gaming system may require a predetermined wager threshold so that all of the game features (e.g., the second set of game reels, the accumulator reels, symbols storage, award enhancements, and pay tables for each set of game reels separately and a pay table for the combined sets of game reels, etc.) are available for a play of the game. The predetermined wager threshold can be any suitable amount (e.g., 200 credits). In the illustrated FIGS. 4A-4D, the player placed a wager for each play of the game that is greater than or equal to the assigned predetermined wager, making all game features potentially available to the player for the plays of the game.

To initiate a play of the game, the player activates or presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button, a spin button, or a lever. The gaming system may deduct the appropriate credits from the player's credit balance after the wager or at any suitable time.

Upon receipt of the player's wager and activation of the game start button, the gaming system may show a display of spinning reels for each of the first set of game reels 402*a*-402*c*; the second set of game reels 403*a*-403*c*; and the accumulator reels 404*a* and 404*b*. The spinning (not shown) may appear to occur in a vertical top to bottom direction or in a vertical bottom to top direction, or in a combination of vertical directions. In one embodiment, the gaming system randomly generates symbols from the associated sets of symbols for the first set of game reels 402*a*-402*c*; the second set of game reels 403*a*-403*c*; and the accumulator reels 404*a* and 404*b*, respectively. As noted above, the gaming system may rely on random generation performed by a pseudo RNG, a true RNG, or hardware RNG specifically designed for gaming systems. In one embodiment, the gaming system may also update the player's credit meter (information area 405*c*) to reflect the player's available credit balance.

As illustrated in FIG. 4A, the gaming system displays the generated game symbols 420*a*-420*i* in the first set of symbol display areas 410*a*-410*i*. Symbols 420*a*-420*i* displayed on reels 402*a*-402*c* illustrate the randomly generated symbols from the associated sets of symbols after the reels have stopped spinning. As illustrated in FIG. 4A, the gaming system randomly generated and displayed game symbols 420*a*, 420*d*, and 420*g* in game symbol display areas 410*a*, 410*d*, and 410*g* for game reel 402*a*. The gaming system also randomly generated and displayed game symbols 420*b*, 420*e*, and 420*h* in game symbol display areas 410*b*, 410*e*, and 410*h* for game reel 402*b*; and game symbols 420*c*, 420*f*, and 420*i* in game symbol display areas 410*c*, 410*f*, and 410*i* for game reel 402*c*. As illustrated in FIG. 4A, the gaming system generated and displayed an A symbol (420*a*), a B symbol (420*i*), a C symbol (420*e*), D symbols (420*b* and 420*c*), F symbols (420*f* and 420*g*), and a G symbol (420*d*) in the game display 400. It should be appreciated that the displayed symbol combinations are merely for explanatory purposes and the gaming system may randomly generate any suitable combination of symbols based on defined symbol sets associated with the game reels 402*a*-402*c*.

FIG. 4A also illustrates the gaming system displaying the generated game symbols 421*a*-421*i* in the second set of symbol display areas 411*a*-411*i*. Game symbols 421*a*-421*i* displayed on game reels 403*a*-403*c* illustrate the randomly generated symbols from the associated sets of symbols after the reels have stopped spinning. As illustrated in FIG. 4A, the gaming system randomly generated and displayed game symbols 421*a*, 421*d*, and 421*g* in game symbol display areas 411*a*, 411*d*, and 411*g* for game reel 403*a*. The gaming system also randomly generated and displayed game symbols 421*b*, 421*e*, and 421*h* in game symbol display areas 411*b*, 411*e*, and 411*h* for game reel 403*b*; and game symbols 421*c*, 421*f*, and 421*i* in game symbol display areas 411*c*, 411*f*, and 411*i* for game reel 403*c*. As illustrated in FIG. 4A, the gaming system generated and displayed 1 symbols (421*h*, 421*i*), a 2 symbol (421*g*), 3 symbols (421*b*, 421*d*, 421*e*, and 421*f*), and 4 symbols (421*a* and 421*c*) in the game display 400. It should be appreciated that the displayed symbol combinations are merely for explanatory purposes and the gaming system may randomly generate any suitable combination of symbols based on defined symbol sets associated with the game reels 403*a*-403*c*.

FIG. 4A further illustrates the gaming system displaying the generated accumulator symbols 440*a*-440*c* in a first accumulator set of symbol display areas 430*a*-430*c* and the generated accumulator symbols 440*d*-440*f* in a second accumulator set of symbol display areas 430*d*-430*f*. Accumulator symbols 440*a*-440*c* displayed on accumulator reel 404*a* illustrate the randomly generated accumulator symbols from the associated set of accumulator symbols after the accumulator reel has stopped spinning. As illustrated in FIG. 4A, the gaming system randomly generated and displayed accumulator symbols 440*a*, 440*b*, and 440*c* in accumulator symbol display areas 430*a*, 430*b*, and 430*c* for accumulator reel 404*a*. The gaming system generated and displayed an A symbol (440*a*), an F symbol (440*b*), and a G symbol (440*c*) in the game display 400. Accumulator symbols 440*d*-440*f* displayed on accumulator reel 404*b* illustrate the randomly generated accumulator symbols from the associated set of accumulator symbols after the accumulator reel has stopped spinning. As illustrated in FIG. 4A, the gaming system randomly generated and displayed accumulator symbols 440*d*, 440*e*, and 440*f* in accumulator symbol display areas 430*d*, 430*e*, and 430*f* for accumulator reel 404*b*. The gaming system generated and displayed a 3 symbol (440*d*), a 4 symbol (440*e*), and a 2 symbol (440*f*) in the game display 400. It should be appreciated that the displayed symbol combinations are merely for explanatory purposes and the gaming system may randomly generate any suitable combination of symbols based on defined symbol sets associated with the accumulator reels 404*a* and 404*b*.

FIG. 4A illustrates one embodiment of the gaming system that executed a first evaluation of the generated symbols on game reels 402*a*-402*c* for winning symbol combinations; a second evaluation of the generated symbols on game reels 403*a*-403*c* for winning symbol combinations; and a third combined evaluation of the generated symbols on game reels 402*a*-402*c* and 403*a*-403*c* for winning symbol combinations. The gaming system evaluated these generated symbols based on the example pay tables 600 listed in FIG. 6. For example, the generated symbols on game reels 402*a*-402*c* are evaluated against the left game pay table for winning symbol combinations; the second evaluation of the generated symbols on game reels 403*a*-403*c* are evaluated against the right game pay table for winning symbol combinations; and the third combined evaluation of the generated symbols on game reels 402*a*-402*c* and 403*a*-403*c* are evaluated against the combo game pay table for winning symbol combinations. However, any suitable pay tables can be used. As noted above, the player may have wagered on one or more pay lines (such as 10 pay lines shown in information area 405*h*). In one embodiment, at least the active (wagered on pay lines) are evaluated for winning symbol combinations. In some embodiments, all pay lines are evaluated for winning symbol combinations. In some embodiments, any suitable number of pay lines may be used to evaluate winning symbol combinations.

In the embodiment illustrated in FIG. 4A, the gaming system evaluated the generated symbol combinations for winning symbol combinations. In some embodiments, the first evaluation of game reels 402*a*-402*c* for winning symbol combinations occur starting from the symbols of the right most game reel 402*c* and move towards the game symbols on game reel 402*a*. In some embodiments, the second evaluation of game reels 403*a*-403*c* for winning symbol combinations occur starting from the symbols of the left most game reel 403*a* and move towards the game symbols on game reel 403*c*. In some embodiments, the gaming system also evaluates all of the generated game symbols (e.g., using a combination of all of the reels—except for the accumulator reels) for the third evaluation, where the evaluation may start from game reel 402*a* and move right towards game reel 403*c*. However, it should be appreciated that any suitable evaluation direction can be used. In some embodiments, fewer than all of the game reels are used in the third evaluation. In some embodiments, the accumulator reels can be used in the evaluation for winning symbol combinations.

In FIG. 4A, the gaming system determined that a winning symbol combination is displayed across one wagered pay line. The pay line spans across a horizontal direction of symbol display areas including symbol display areas 411*d*, 411*e*, and 411*f*. In this embodiment, the gaming system displayed three 3 symbols along a horizontal pay line on which the player had placed a wager. The gaming system determined the three 3 symbols form a winning symbol combination based on a pay table associated with the gaming system (such as the right side pay table in FIG. 6). The winning pay line is illustrated as pay line 424*a* in FIG. 4A across the row of game reels 403*a*-403*c*. The gaming system provides a credit award for the three 3 symbols in accordance right side pay table in FIG. 6.

The gaming system also determines if the gaming system should generate any storage symbols in some embodiments. In one embodiment, the gaming system evaluates each row of the accumulator symbols in accumulator reel 404*a* against an associated row of game symbols of reels 402*a*-402*c*. For example, the gaming system evaluates the A symbol 440*a* in accumulator symbol display area 430*a* against the game symbols from the first row of reels 402*a*-402*c*. The gaming system may compare the A symbol 440*a* against the symbols 420*a*, 420*b*, and 420*c* to see if any of these symbols match with the A symbol 440*a*. As illustrated in FIG. 4A, the gaming system determines that game symbol 420*a* in symbol display area 410*a* matches with the accumulator symbol 440*a* of the accumulator reel 404*a*. As a result of such a match, the gaming system generates an A storage symbol and places the A storage symbol in symbol display area 450*p* of the symbol storage area. In FIG. 4A, the gaming system highlights A symbol 420*a* with a box 414 to indicate to a player that the A symbol 420*a* helped create the A storage symbol. It should be appreciated that any suitable mechanism to highlight or indicate to a player that the A symbols 420*a* helped create the A storage symbol.

In some embodiments, the generated storage symbols are persistent in the symbol storage area for a predetermined quantity of games (or plays of the game). For example, the predetermined quantity can be two plays of the game, five plays of the game, or some other suitable number. In some embodiments, the gaming system permits the generated storage symbols to persist for an unlimited quantity of games. In one embodiment, when the predetermined quantity is two plays of the game, for each additional spin up to two spins, the A storage symbol in symbol display area 450*p* will continue to be displayed and enable the player to win an award enhancement based on this symbol when the gaming system determines that certain winning conditions are created. In some embodiments, the gaming system will remove the A storage symbol in symbol display area 450*p* once the gaming system determines that the A storage symbol is part of a winning condition and results in the gaming system providing an award enhancement. In such an embodiment, the gaming system may remove the A storage symbol in symbol display area 450*p* before the predetermined quantity of plays of the game have been executed. As is also illustrated in FIG. 4A, the gaming system highlighted the accumulator A symbol 440*a* with box 413 to further indicate to the player that the accumulator symbol 440*a* helped create the A storage symbol in symbol display area 450*p*.

The gaming system performs a similar matching process with the other accumulator symbols displayed in accumulator reel 404*a* against the game symbols in game reels 402*a*-402*c*. The gaming system also performs a similar matching process with the accumulator symbols displayed in accumulator reel 404*b* against the game symbols in game reels 403*a*-403*c*. As a result, the gaming system determined that three other game symbols in three other symbol display areas match with symbols in the accumulator reel 404*a* and accumulator reel 404*b*, respectively. For example, the accumulator F symbol 440*b* matched with the game F symbol 420*f* in the same row of both reels. As a result, the gaming system generated an F storage symbol for the symbol display area 450*q* in the symbol storage area and highlighted the F symbol 420*f* with box 416. The gaming system also highlighted the accumulator F symbol 440*b* with box 412.

The accumulator 3 symbol 440*d* matched with the game 3 symbol 421*b* in the same row of both reels of the second set of game reels 403*a*-403*c*. As a result, the gaming system generated a 3 storage symbol for the symbol display area 450*r* in the symbol storage area and highlighted the 3 symbol 421*b* with box 419. The gaming system also highlighted the accumulator 3 symbol 440*d* with box 422. Similarly, the gaming system generated a 2 storage symbol for the symbol display area 450*s* in the symbol storage area and highlighted the 2 symbol 421*g* with box 418. The gaming system also highlighted the accumulator 2 symbol 440*f* with box 423.

As illustrated in FIG. 4A, the gaming system updated the player's win meter (shown in information area 405*d*) to reflect that the player has won the 5000 credit award during the bonus game. The gaming system also updated the player's credit balance (shown in information area 405*c*) to reflect the updated credit balance.

While FIG. 4A-4D are discussed in terms of matching accumulator symbols in the same substantially horizontal row as a row with game symbols, in some embodiments, accumulator symbols can be matched with game symbols in other suitable patterns or ways.

As can be appreciated, the initial game did not provide large pay outs. However, the gaming system generated numerous storage symbols in the symbol storage area that can lead to award enhancements (as will be discussed below). With the prospect of additional award enhancements associated with the generated storage symbols, the player is encouraged to continue playing additional plays of the game. As previously discussed, the generated storage symbols remain persistently displayed for at least two additional plays of the game, creating temporary storage symbol accumulations.

At the conclusion of the first play of the game, the player may continue the gaming session by playing another play of the game. That is, the player may place another wager and start a new play of the game, and keep any displayed persistent storage symbols for at least the next play of the game. However, continued game play is dependent on the number of credits remaining in the player's credit balance. The player may also choose to cash out. If the player chooses to cash out, the gaming system may provide the player a value based on the player's credit balance using any of the value items discussed above (bills, coins, vouchers, etc.). In some embodiments, if the player chooses the cash out with storage symbols remaining in the symbol storage area, the gaming system removes the storage symbols so that a next player does not have access to the generated storage symbols.

Figure 4B:
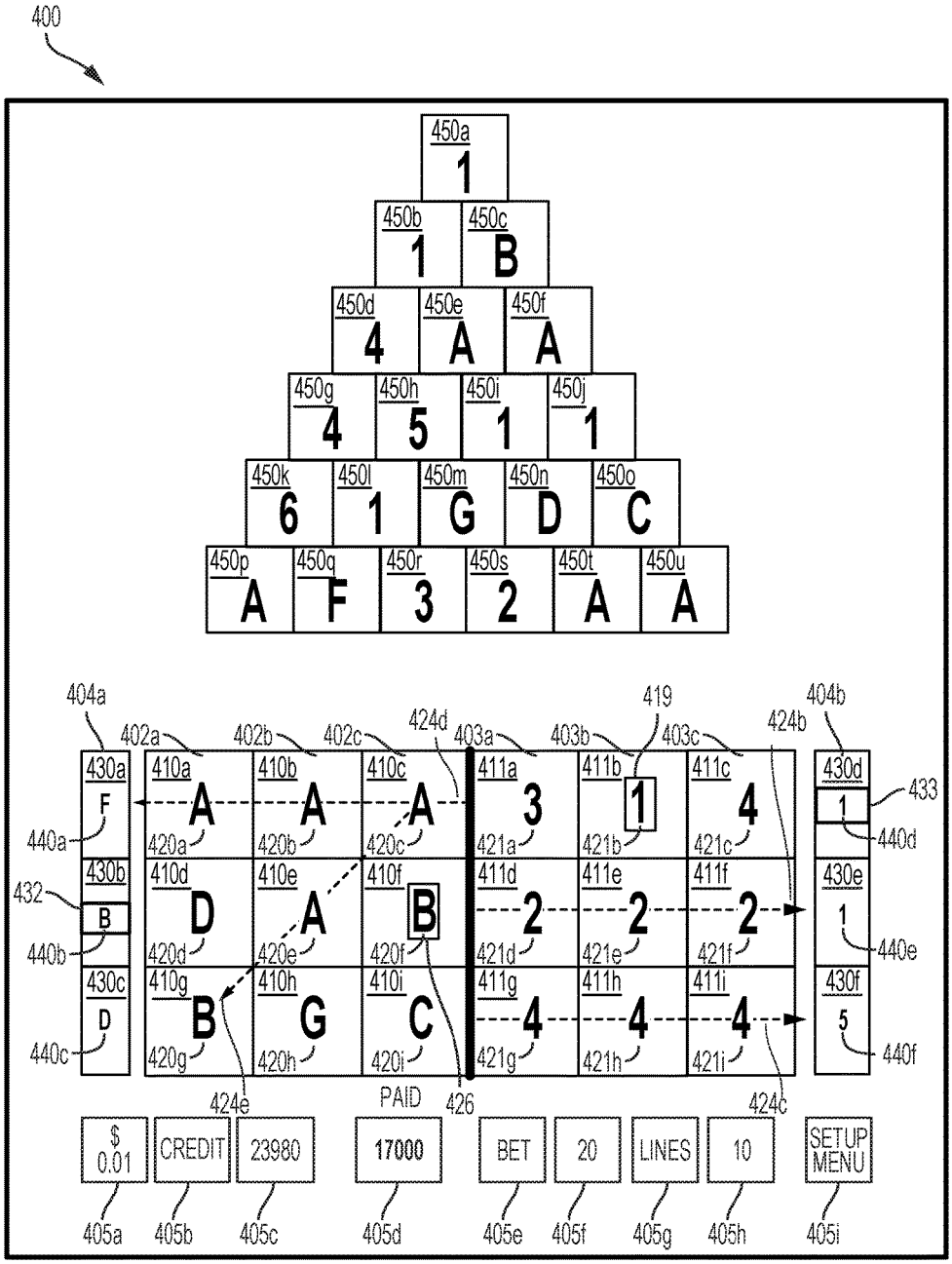

Turning to FIG. 4B, a game display of the gaming system is illustrated after the gaming system executed a plurality of games (e.g., the gaming system executed a plurality of plays of a game or a plurality of plays of different games). During the prior plurality of games (not shown except for FIG. 4A), the gaming system nearly filled up pyramid symbol storage area, except for two symbol display areas of the symbol storage area (450*a* and 450*c*). In particular, the gaming system generated storage symbols for each of symbol display areas 450*b*-450*u* in the symbol storage area during the prior plurality of plays of the game. As the gaming system executed the plurality of plays of the game, the gaming system also kept the previously generated storage symbols in their respective symbol display areas of the symbol storage area.

FIG. 4B illustrates that the gaming system generated another plurality of symbols for each set of game reels and for the accumulator reels, for a new play of the game. The gaming system replaced the previously displayed game symbols for each of the game reels with the replacement generated game symbols for the new play of the game. The gaming system also replaced the previously displayed accumulator symbols for each of the accumulator reels with replacement accumulator symbols for the new play of the game. FIG. 4B also illustrates that the gaming system generated the last two storage symbols necessary to fill up the symbol storage area (symbol display areas 450*a* and 450*c*).

In the embodiment illustrated in FIG. 4B, the gaming system evaluated the generated symbol combinations for winning symbol combinations in accordance with the evaluation directions discussed in connection in FIG. 4A.

FIG. 4B illustrates that the gaming system executed a first evaluation of the generated symbols on reels 402*a*-402*c* for winning symbol combinations; a second evaluation of the generated symbols on reels 403*a*-403*c* for winning symbol combinations; and a third combined evaluation of the generated symbols on reels 402*a*-402*c* and 403*a*-403*c* for winning symbol combinations. The gaming system evaluated these generated symbols based on the example pay tables 600 listed in FIG. 6. Like in FIG. 4A, the generated symbols on reels 402*a*-402*c* are evaluated against the left game pay table for winning symbol combinations; the second evaluation of the generated symbols on reels 403*a*-403*c* are evaluated against the right game pay table for winning symbol combinations; and the third combined evaluation of the generated symbols on reels 402*a*-402*c* and 403*a*-403*c* are evaluated against the combo game pay table for winning symbol combinations.

In FIG. 4B, the gaming system determined that four different winning symbol combinations are displayed across four wagered pay lines. Two pay lines span across a horizontal direction and a diagonal direction of symbol display areas including symbol display areas 410*c*, 410*b*, and 410*a* and symbol display areas 410*c*, 410*e*, and 410*g*. Another two pay lines span across a horizontal direction of the second set of game reels. One such pay line spans across symbol display areas 411*d*, 411*e*, and 411*f* and the other pay line spans across symbol display area 411*g*, 411*h*, and 411*i*. The gaming system determined the three A symbols along pay line 424*d*, two A symbols along pay line 424*h*, three 2 symbols along pay line 424*b*, and three 4 symbols along pay line 424*c* form four separate winning symbol combinations based on the pay tables in FIG. 6. The gaming system determines that the player's award based on the symbol combinations on wagered pay lines in accordance with the example pay table of FIG. 6.

The gaming system also determines if the gaming system should generate any new storage symbols in the symbol storage area for the current play of the game. As discussed above, the gaming system may evaluate each row of the accumulator symbols in accumulator reel 404*a* against an associated row of game symbols of reels 402*a*-402*c* for symbol matches. The gaming system may also evaluate each row of the accumulator symbols in accumulator reel 404*b* against an associated row of game symbols of reels 403*a*-403*c* for symbol matches.

In FIG. 4B, the gaming system determined that the accumulator B symbol 440*b* in accumulator symbol display area 430*b* matched against the game B symbol 420*f* in the game symbol display area 410*f*. As a result of such a match, the gaming system generates a B storage symbol in symbol display area 450*c* of the symbol storage area. The gaming system also generated a box 426 in the symbol display area 410*f* to highlight the B symbol 420*f* as creating a new storage symbol. Likewise, the gaming system generated a box 432 in accumulator symbol display area 430*b* to highlight the B accumulator symbol 440*b* as creating a new storage symbol.

In FIG. 4B, the gaming system also determined that the accumulator 1 symbol 440*d* in accumulator symbol display area 430*d* matched against the game 1 symbol 421*b* in the game symbol display area 411*b*. As a result of such a match, the gaming system generates a 1 storage symbol in symbol display area 450*a* of the symbol storage area. The gaming system also generated a box 419 in the symbol display area 411*b* to highlight the 1 symbol 421*b* as creating a new storage symbol. The gaming system also highlighted the accumulator 1 symbol 440*d* with box 433.

In some embodiments, the gaming system may determine if a predetermined quantity of storage symbols are contained in the symbol storage area. In the illustrated embodiment, the predetermined quantity of storage symbols is equivalent to the number of symbol display areas in the symbol storage area. In the embodiment of FIG. 4B, the predetermined quantity of storage symbols is 21 and thus the gaming system determines whether the symbol storage area includes 21 storage symbols. Because the gaming system determines that the symbol storage area includes 21 storage symbols, the gaming system evaluates the storage symbols in the symbol storage area for winning conditions.

Figure 4C:
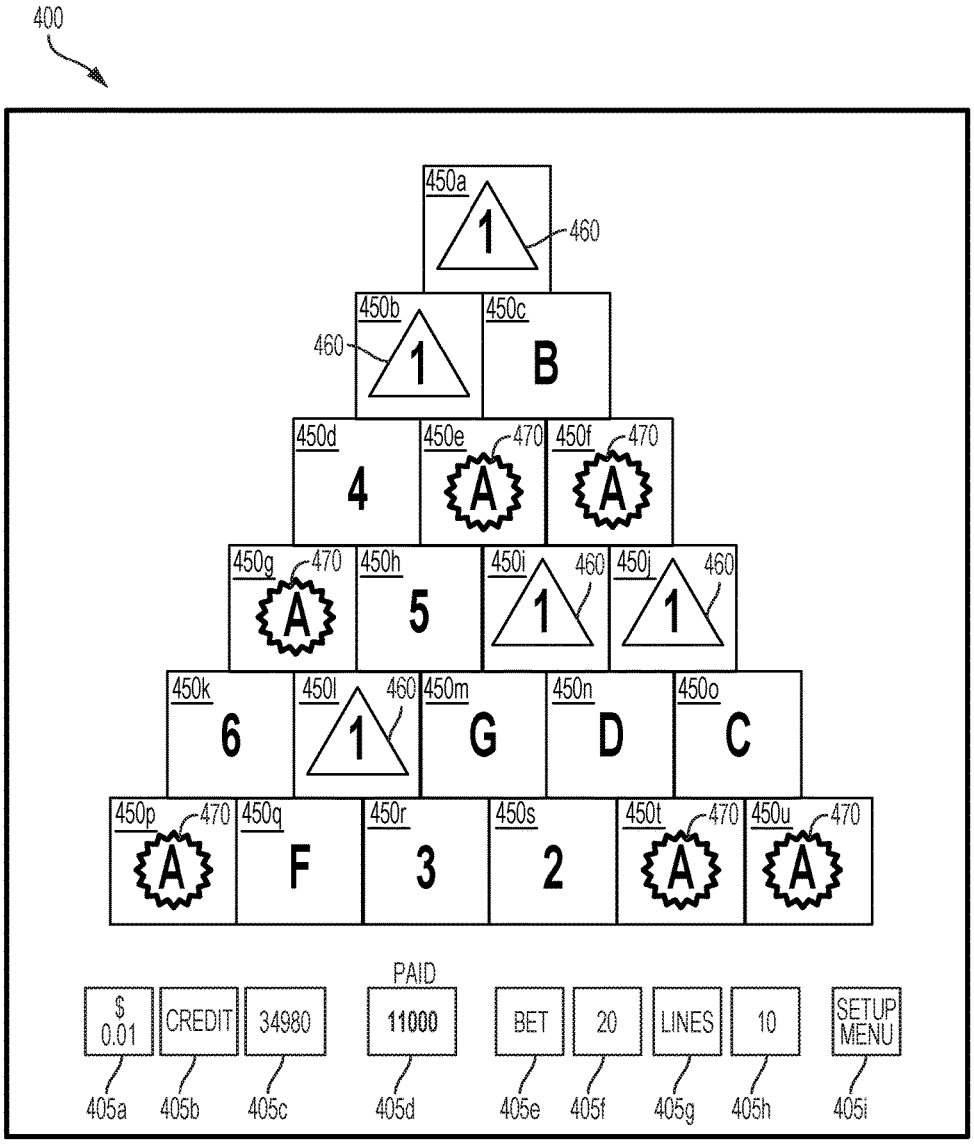

Turning the FIG. 4C, in one embodiment, the gaming system may remove the game reels and the accumulator reels and enlarge the symbol storage area to better illustrate the gaming system's evaluation of the storage symbols. It should be appreciated that in some embodiments, the gaming system does not remove the game reels and the accumulator reels for the evaluation of the storage symbols.

Figure 7:
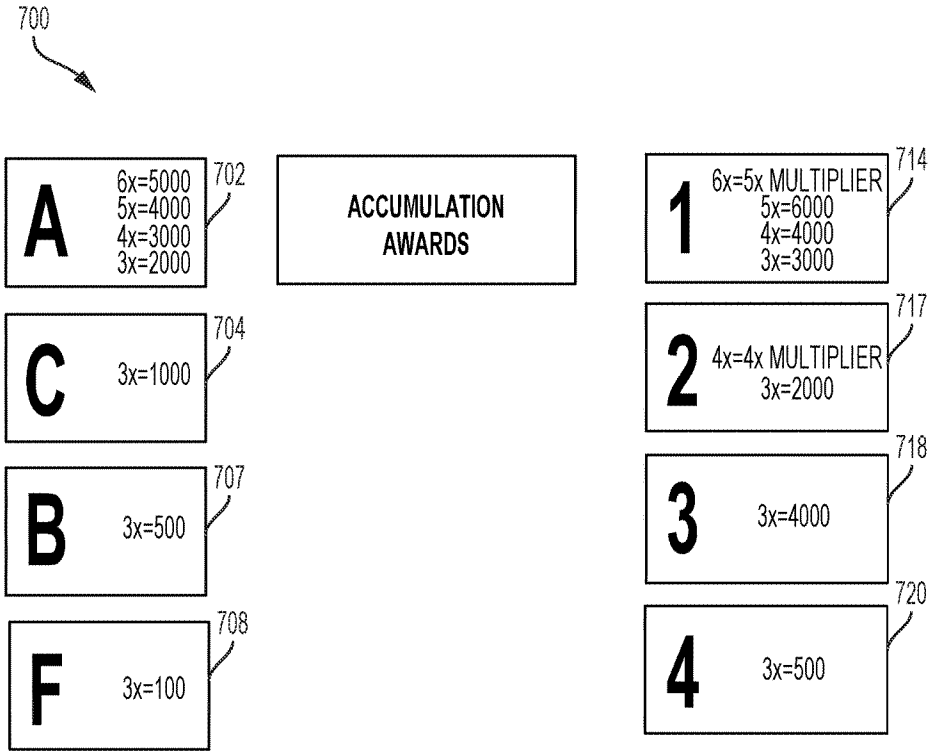

In one embodiment, the gaming system performs an evaluation of the storage symbols in the symbol storage area for winning conditions. In some embodiments, the winning conditions are listed in a pay table associated with the gaming system and the symbol storage area. One example pay table is illustrated in FIG. 7 for the symbol storage area. However, it should be appreciated that any suitable pay table can be used. In FIG. 4C, the gaming system determined that the symbol storage area contained six A storage symbols (in symbol display areas 450*e*, 450*f*, 450*g*, 450*p*, 450*t*, and 450*u*). The gaming system may compare the six A symbols to the pay table in FIG. 7 to determine the award or award enhancement. As also illustrated in FIG. 4C, the gaming system generated star shaped highlights 470 around each of the A storage symbols in the symbol storage area to inform the player that these A storage symbols resulted in an award or award enhancement. It should be appreciated that any suitable highlighting mechanism can be used (or no highlighting mechanism).

In FIG. 4C, the gaming system further determined that the symbol storage area contained five 1 storage symbols (in symbol display areas 450*a*, 450*b*, 450*i*, 450*j*, and 450*l*). The gaming system may compare the five 1 symbols to the pay table in FIG. 7 to determine the award. As also illustrated in FIG. 4C, the gaming system generated triangle shaped highlights 460 around each of the 1 storage symbols in the symbol storage area to inform the player that these 1 storage symbols resulted in an award or award enhancement. It should be appreciated that any suitable highlighting mechanism can be used (or no highlighting mechanism).

As illustrated in FIG. 4C, the gaming system did not consider any particular placement of the storage symbols in the symbol storage area when evaluating the storage symbols for winning conditions. However, in some embodiments, the gaming system may use a pay table that requires that the symbols be arranged in a particular order or display format before the gaming system will determine that a winning condition is triggered. For example, in some embodiments, the gaming system may require that a particular storage symbol is displayed on each row, or that a particular symbol is displayed on adjacent or touching symbol display areas in the symbol storage area to trigger a winning condition.

In some embodiments, the gaming system updates the player's win meter (shown in information area 405*d*) to reflect that the award credits the player won during the play of the game (including the awards associated with symbols on the game reels and the award enhancements from the storage symbols in the symbol storage area). In some embodiments, the gaming system also updates the player's credit balance (shown in information area 405*c*) to reflect an addition of the new award credits for the play of the game.

Figure 4D:
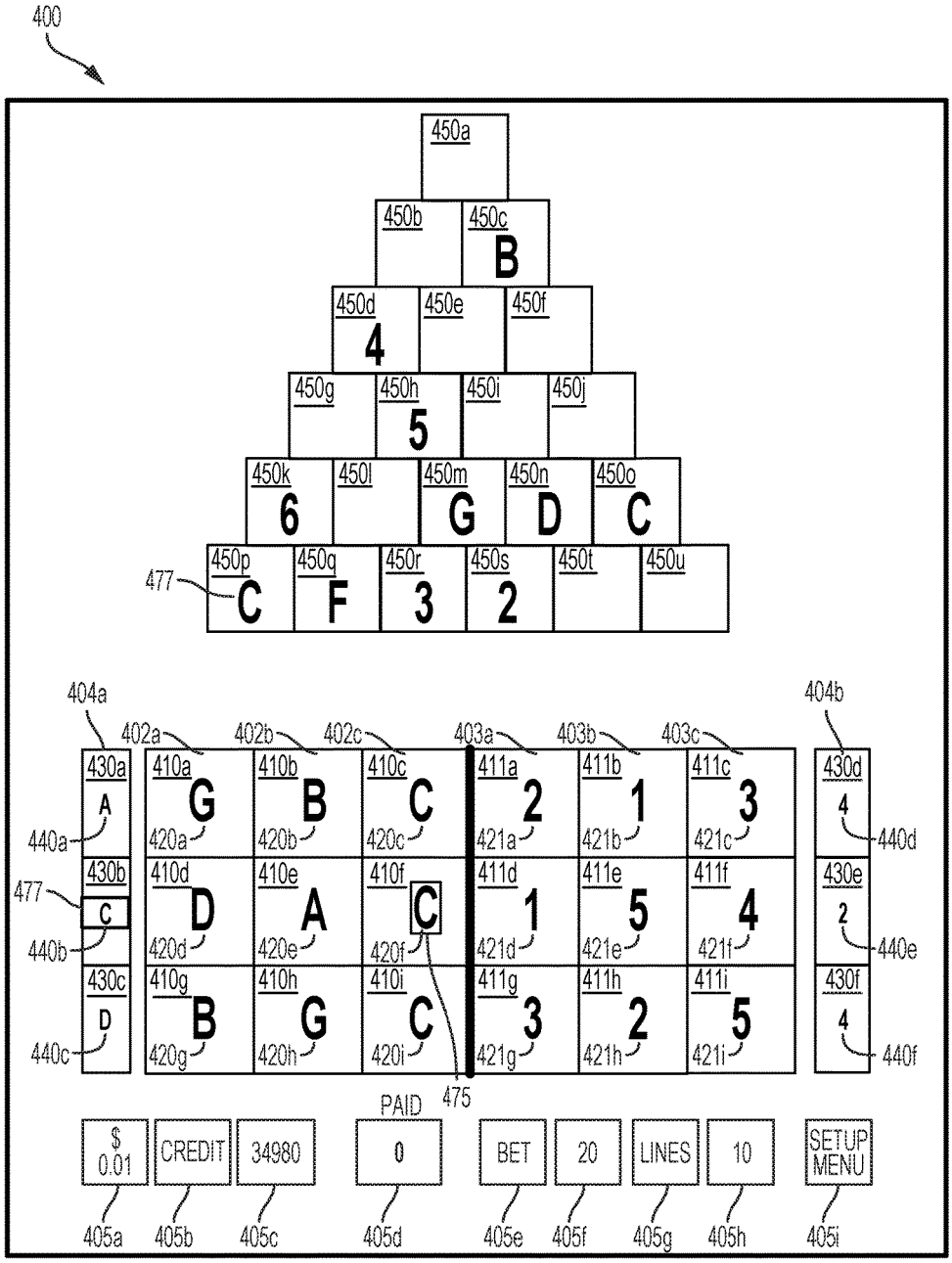

In some embodiments, the gaming system removes any storage symbols from the symbol storage area that were used as part of a winning condition or to form a set of winning symbol combinations. For example, because the A storage symbols and the 1 storage symbols in the symbol storage area were used to form winning conditions, the gaming system will remove these storage symbols so these symbols are not available for a next play of the game (as shown in FIG. 4D). These storage symbols can be removed during the current play of the game or during the next play of the game (but before such storage symbols slated for removal are used to trigger or evaluate winning conditions). In some embodiments where each of the displayed storage symbol persists for a predetermined quantity of games, the gaming system may allow the A storage symbols and the 1 storage symbols to remain in the symbol storage area until such storage symbols persisted for the predetermined quantity of games. In some embodiments, the gaming system may allow the storage symbols other than the A storage symbols and the 1 storage symbols to remain or persist in the symbol storage area for at least another play of the game. However, in some embodiments, the gaming system may remove all symbols in the symbol storage area once any of the winning symbols triggers or is associated with a winning condition.

In some embodiments, the gaming system may also determine if any stored storage symbols have been displayed for a predetermined quantity of games (e.g., two games, five games, etc.). In the example of FIG. 4B, none of the displayed storage symbols (not associated with triggering a winning condition) have been displayed for the predetermined quantity of games so the gaming system does not remove any additional storage symbols.

At the conclusion of a play of the game, the player may continue the gaming session by playing another play of the game. That is, the player may place another wager and start a new play of the game, and keep the persistent storage symbols for the additional play of the game. However, continued game play is dependent on the number of credits remaining in the player's credit balance. The player may also choose to cash out. If the player chooses to cash out, the gaming system may provide the player a value based on the player's credit balance using any of the value items discussed above (bills, coins, vouchers, etc.). In some embodiments, if the player chooses the cash out with storage symbols remaining, the gaming system removes the storage symbols so that a next player does not have access to the existing generated storage symbols.

Turning to FIG. 4D, a game display of the gaming system is illustrated after the gaming system executed another play of the game. During the prior play of the game, the gaming system filled up pyramid symbol storage area and proceeded to evaluate the storage symbols in the symbol storage area for winning conditions. As a result of two sets of winning conditions (e.g., the A symbols and 1 symbols), the gaming system provided a plurality of awards (e.g., for the winning symbol combinations for the game symbols and award enhancements for the winning conditions from the symbol storage area). As a result of the winning conditions, the gaming system also removed a plurality of storage symbols associated with the winning conditions from the symbol storage area. In particular, the gaming system removed symbols from the symbol display areas 450*a*, 450*b*, 450*e*, 450*f*, 450*g*, 450*i*, 450*j*, 450*l*, 450*p*, 450*t* and 450*u*. In some embodiments, the gaming system leaves other storage symbols that did not generate winning conditions in the symbol storage area so that the player can start to rebuild the collection of storage symbols in the symbol storage area without starting from zero storage symbols. In some embodiments, the gaming system enables the player to begin to collect additional storage symbols to fill in the empty symbol display areas 450*a*, 450*b*, 450*e*, 450*f*, 450*g*, 450*i*, 450*j*, 450*l*, 450*p*, 450*t* and 450*u* in the symbol storage area in this play of the game and in additional plays of the game. Having a plurality of persistent storage symbols remaining may entice a player to continue to play additional plays of the game in the hopes that the player can achieve a full pyramid and obtain additional enhanced awards (in a shorter time frame than when the player started with zero storage symbols in the symbol storage area).

FIG. 4D illustrates that the gaming system generated another plurality of symbols for each set of game reels and for the accumulator reels, for a new play of the game. The gaming system replaced the previously displayed game symbols for each of the game reels with the replacement generated game symbols for the new play of the game. The gaming system also replaced the previously displayed accumulator symbols for each of the accumulator reels with replacement accumulator symbols for the new play of the game. FIG. 4D also illustrates that the gaming system generated one additional storage symbol for the symbol storage area (in symbol display areas 450*p* as illustrated by the C symbol 477).

In this embodiment of FIG. 4D, the gaming system evaluated the generated game symbol combinations for winning symbol combinations in accordance with the evaluations discussed in connection in FIG. 4A.

FIG. 4D illustrates that the gaming system executed a first evaluation of the generated symbols on reels 402*a*-402*c* for winning symbol combinations; a second evaluation of the generated symbols on reels 403*a*-403*c* for winning symbol combinations; and a third combined evaluation of the generated symbols on reels 402*a*-402*c* and 403*a*-403*c* for winning symbol combinations. The gaming system evaluated these generated symbols based on the example pay tables 600 listed in FIG. 6. Like in FIG. 4A, the generated symbols on reels 402*a*-402*c* are evaluated against the left game pay table for winning symbol combinations; the second evaluation of the generated symbols on reels 403*a*-403*c* are evaluated against the right game pay table for winning symbol combinations; and the third combined evaluation of the generated symbols on reels 402*a*-402*c* and 403*a*-403*c* are evaluated against the combo game pay table for winning symbol combinations.

Figure 6:
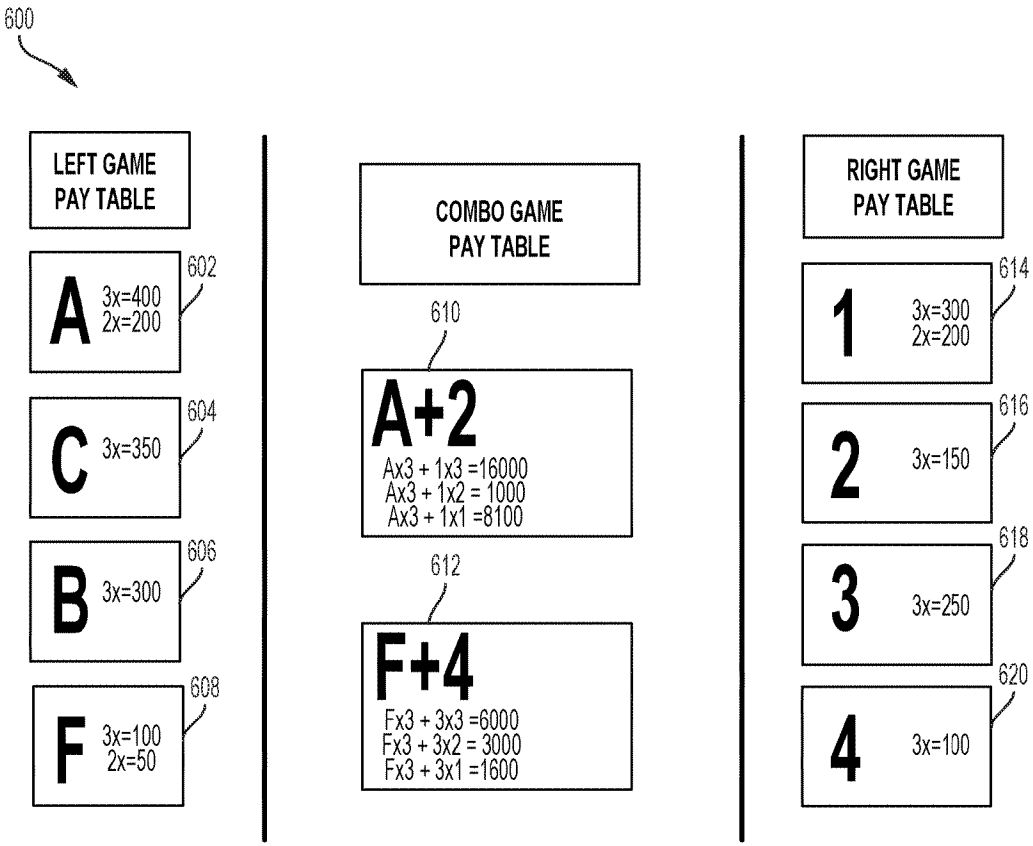
FIG. 6 and FIG. 7 illustrate example embodiments of pay tables for a gaming system having award enhancements based on storage symbols.

In FIG. 4D, the gaming system determined no winning symbol combinations were displayed across wagered pay lines in this play of the game based on the example pay tables in FIG. 6.

The gaming system also determines if the gaming system should generate any new storage symbols in the symbol storage area for the current play of the game. As discussed above, the gaming system may evaluate each row of the accumulator symbols in accumulator reel 404*a* against an associated row of game symbols of reels 402*a*-402*c* for symbol matches. The gaming system may also evaluate each row of the accumulator symbols in accumulator reel 404*b* against an associated row of game symbols of reels 403*a*-403*c* for symbol matches.

In FIG. 4D, the gaming system determined that the accumulator C symbol 440*b* in accumulator symbol display area 430*b* matched against the game C symbol 420*f* in the game symbol display area 410*f*. As a result of such a match, the gaming system generates a C storage symbol in symbol display area 450*p* of the symbol storage area. The gaming system also generated a box 475 in the symbol display area 410*f* to highlight the C symbol 420*f* as creating a new storage symbol. Likewise, the gaming system generated a box 477 in accumulator symbol display area 430*b* to highlight the C accumulator symbol 440*b* as creating a new storage symbol.

In some embodiments, the gaming system may determine if a predetermined quantity of storage symbols are contained in the symbol storage area. In the illustrated embodiment, the predetermined quantity of storage symbols is equivalent to the number of symbol display areas in the symbol storage area. In the embodiment of FIG. 4D, the predetermined quantity of storage symbols is 21 and thus the gaming system determines whether the symbol storage area includes 21 storage symbols. Because the gaming system determines that the symbol storage area does not include 21 storage symbols, the gaming system does not evaluate the storage symbols in the symbol storage area for winning conditions.

At the conclusion of a play of the game, the player may continue the gaming session by playing another play of the game. That is, the player may place another wager and start a new play of the game, and keep the persistent storage symbols for the additional play of the game. However, continued game play is dependent on the number of credits remaining in the player's credit balance. The player may also choose to cash out. If the player chooses to cash out, the gaming system may provide the player a value based on the player's credit balance using any of the value items discussed above (bills, coins, vouchers, etc.). In some embodiments, if the player chooses the cash out with storage symbols remaining, the gaming system removes the storage symbols so that a next player does not have access to the existing generated storage symbols.

Figure 5:
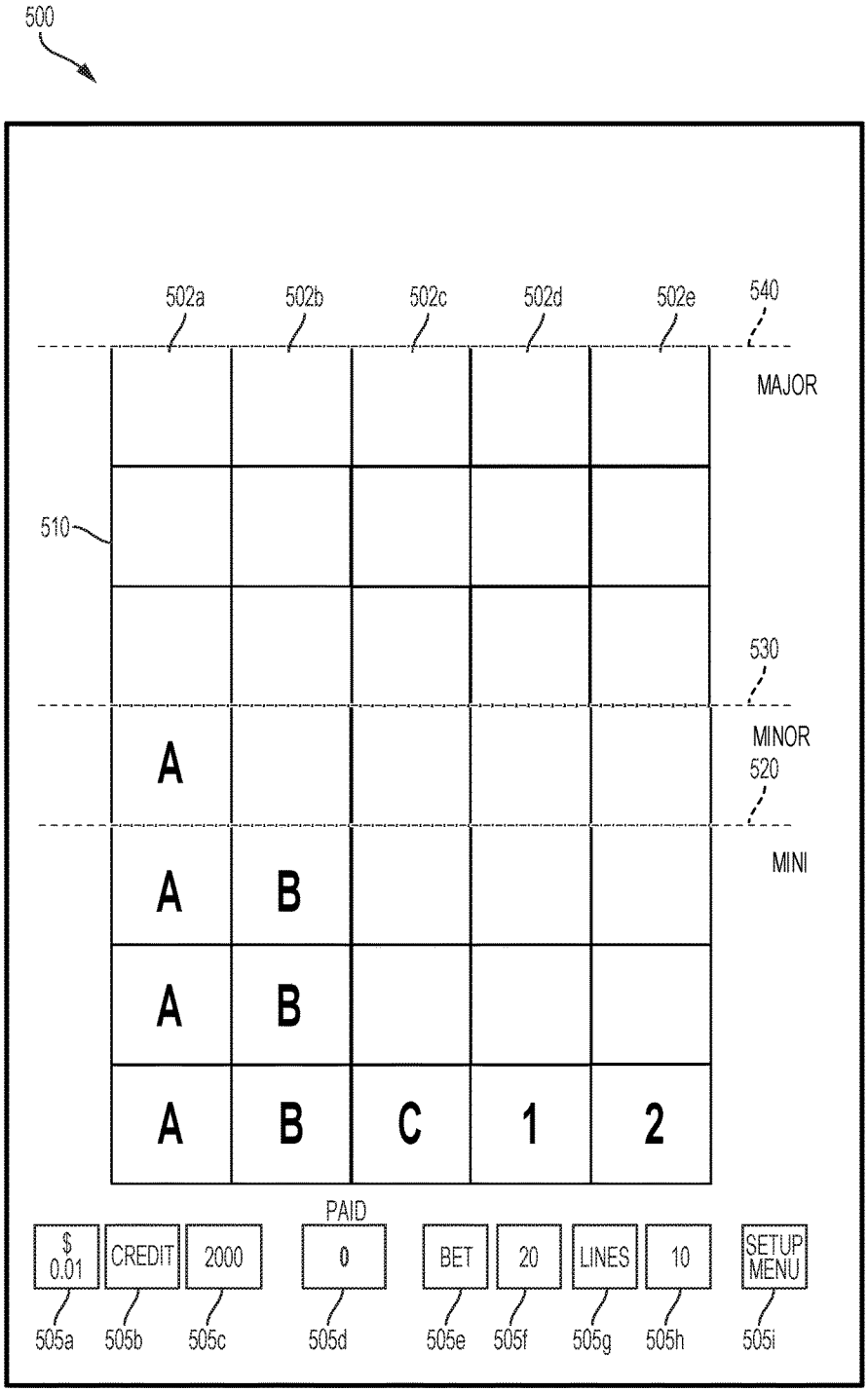
FIG. 5 illustrates screen shots of one embodiment of a gaming system having award enhancements based on storage symbols.

FIG. 5 illustrates one alternative embodiment of a symbol storage area. In some embodiments, the symbol storage area is displayed on a separate display device from a display device that displays symbols used to generate the storage symbols (e.g., the game reels and the accumulator reels). In some embodiments, the symbol storage area can be displayed on a same display device (not shown in FIG. 5).

In this embodiment, the symbol storage area 510 is formed as a rectangle with a plurality of different symbol display areas for storing storage symbols. Like in FIG. 4A-4D, the gaming system may generate symbols from game reels and accumulator reels. However, it should be appreciated that other games can be used to generate storage symbols for the symbol storage area. In one embodiment, the gaming system may populate storage symbols in the symbol storage area 510 from top to bottom or bottom to top, placing generated storage symbols on a first in basis. Thus, in such an embodiment, the gaming system may populate the symbol storage area with different symbols intermixed in different columns and rows.

In some embodiments, the gaming system is configured to place certain storage symbols in certain symbol display areas. As illustrated in FIG. 5, the symbol storage area 510 comprises five columns of symbol display areas (502*a*, 502*b*, 502*c*, 502*d*, and 502*e*). In one embodiment, column 502*a* stores A storage symbols, column 502*b* stores B storage symbols, column 502*c* stores C storage symbols, column 502*d* stores 1 storage symbols, and column 502*e* stores 2 storage symbols. In one such embodiment, the gaming system places A storage symbols in column 502*a* (without intermingling in other symbols in column 502*a*). The same can be done for the other columns 502*b*-502*e*. It should be appreciated that any suitable symbol can be stored in these columns.

In some embodiments, the gaming system can be configured to evaluate the storage symbols in the symbol storage area 510 at a plurality of different levels of collected storage symbols. That is, the symbol storage area may have a plurality of different storage symbol fill levels. As the gaming system generates additional storage symbols and begins to fill the symbol storage area with storage symbols, the gaming system may issue different awards depending on how full the symbol storage area is with storage symbols. In some embodiments, the gaming system associates a plurality of different awards with different quantities of collected storage symbols (e.g., a mini, minor, major award), that are each associated with the quantity of symbols that fill the symbol storage area. In some such embodiments, the gaming system determines a first award if the symbol storage area is filled with a first predetermined quantity of storage symbols; determines a second award if the symbol storage area is filled with a second predetermined quantity of storage symbols; and determines a third award if the symbol storage area is filled with a third predetermined quantity of storage symbols. In some embodiments, at least two of the first award, second award, and third award are different. In some embodiments, all of the first, second, and third awards are different. In some embodiments, the first award may be a mini award 520 (or the smallest award of the three), the second award may be minor award 530 (an award that is larger than the first award, but smaller than the third award), and the third award may be a major award 540 (or an award larger than the first and second awards). It should be appreciated that any suitable quantity of different awards can be associated with different quantities of storage symbols collected in the symbol storage area 510.

In the illustrated embodiment of FIG. 5, the gaming system determined that four A symbols in column 502*a* triggered a winning condition to win the minor award 530. In some embodiments, the gaming system may also provide the mini award based on the A symbols. However, in some embodiments, the gaming system provides only the larger award. Likewise, the gaming system determined that three B symbols in column 502*a* triggered a winning condition to win the mini award 520. In the illustrated embodiment of FIG. 5, none of the columns of symbols reached the major award 540. These awards can be associated with any suitable type of awards, such as credits and multipliers. While not discussed, the symbol storage area 510 of FIG. 5 can be used with a reel game such as described above in connection with FIG. 4A-4D. However, the symbol storage area of both FIG. 4A-4D and FIG. 5 can be used with any suitable game.

FIG. 6 illustrates a screen shot of one embodiment of a pay table 600 for a game of the gaming system. Tables 602, 604, 606, 608, 610, 612, 614, 616, 618, and 620 are merely example payout awards for example symbol combinations for different sets of game reels. As noted above, it should be appreciated that the pay tables are merely illustrative, and the symbols, awards, and the credit values may all be modified in any suitable manner.

FIG. 7 illustrates a screen shot of one embodiment of a pay table for award enhancements that stem from storage symbols of the gaming system. As noted above, it should be appreciated that the pay table is merely illustrative, and the symbols, awards, and the credit values may all be modified in any suitable manner.

By enabling the player to collect and store storage symbols over multiple plays of a game and combining awards associated with the storage symbols with standard awards (e.g., awards from evaluating the generated game symbols for winning symbol combinations), the gaming system offers players many new ways to obtain game awards and enhances players' excitement for a game. The new potential to improve or earn greater awards creates a greatly improved sense of anticipation for players.

A number of embodiments of the invention have been described. Various modifications may be made without departing from the spirit and scope of the invention. For example, various forms of the flows shown above may be used, with steps re-ordered, added, or removed. Accordingly, other embodiments are within the scope of the following claims.

I claim:

1. A gaming system comprising:

a cabinet;

a processor;

a display device supported by the cabinet;

an input device supported by the cabinet;

a value acceptor supported by the cabinet;

a value dispenser supported by the cabinet;

a memory device that stores a plurality of instructions which, when executed by the processor, cause the processor to:

establish a credit balance based at least in part on a monetary value received by the value acceptor;

place a wager following receipt of a wager input via an input device, the credit balance being decreased by the wager;

randomly generate a plurality of game symbols for a game set of symbol display areas;

display, on the display device, the plurality of game symbols in the game set of symbol display areas;

randomly generate a plurality of accumulator symbols in an accumulator set of symbol display areas, the accumulator set of symbol display areas being associated with the game set of symbol display areas;

display, on the display device, the plurality of accumulator symbols in the accumulator set of symbol display areas;

determine matches between the displayed game symbols and the generated plurality of accumulator symbols;

generate a plurality of storage symbols for a storage set of symbol display areas based on the matches between the displayed plurality of game symbols and the displayed plurality of accumulator symbols, wherein a storage symbol of the plurality of storage symbols is generated based on a match between one game symbol of the displayed plurality of game symbols and one accumulator symbol of the displayed plurality of accumulator symbols;

display the generated plurality of storage symbols;

determine awards based on the plurality of game symbols;

if a quantity of the plurality of storage symbols is equal to or greater than a predetermined quantity of symbols, determine additional awards based on the plurality of storage symbols;

display, on the display device, the determined awards and the additional awards, the credit balance being increased by the determined awards and the additional awards; and issue value from the value dispenser based on the credit balance upon receipt of a cash out signal.

2. The gaming system of claim 1, wherein the generated plurality of storage symbols are duplicate symbols of the matching symbols between the generated game symbols and the generated plurality of accumulator symbols.

3. The gaming system of claim 1, wherein the processor further:

randomly generates a plurality of replacement game symbols for the game set of symbol display areas and a plurality of replacement accumulator symbols for the accumulator set of symbol display areas;

determines if at least one of the generated replacement game symbols matches with at least one of the generated plurality of replacement accumulator symbols;

generates additional storage symbols for the storage set of symbol display areas where the processor further determines matches between the generated replacement game symbols and the generated plurality of replacement accumulator symbols; and if a second quantity of the plurality of storage symbols and the additional storage symbols is equal to or greater than the predetermined quantity of symbols, determine the additional awards based on the plurality of storage symbols.

4. The gaming system of claim 1, wherein the storage set of symbol display areas are displayed in a display area apart from the game set of symbol display areas.

5. The gaming system of claim 1, wherein the storage set of symbol display areas are organized in a geometric shape.

6. The gaming system of claim 5, wherein the geometric shape is a pyramid.

7. The gaming system of claim 6, wherein the processor further determines if the pyramid is filled with the predetermined quantity of symbols.

8. The gaming system of claim 6, wherein the processor further determines if the pyramid is completely filled with symbols before determining the additional awards based on the plurality of storage symbols.

9. The gaming system of claim 8, wherein the processor determines the additional awards based on a total quantity of at least one type of the plurality of storage symbols in the storage set of symbol display areas.

10. The gaming system of claim 9, wherein the processor determines the additional awards regardless of displayed positions of the at least one type of the plurality of storage symbols in the storage set of symbol display areas.

11. The gaming system of claim 5, wherein the geometric shape is a rectangle.

12. The gaming system of claim 11, wherein the processor further:

determines a first award if the rectangle is filled with a first predetermined quantity of storage symbols;

determines a second award if the rectangle is filled with a second predetermined quantity of storage symbols; and determines a third award if the rectangle is filled with a third predetermined quantity of storage symbols.

13. The gaming system of claim 12, wherein at least two of the first award, second award, and third award are different.

14. The gaming system of claim 1, wherein the game set of symbol display areas are associated with a plurality of game reels and the accumulator set of symbol display areas are associated with an accumulator reel.

15. The gaming system of claim 14, wherein when determining if the generated game symbol matches with the at least one of the plurality of accumulator symbols, the processor further determines if the generated game symbol and the at least one of the plurality of accumulator symbols are displayed in a same row of the plurality of game reels and the accumulator reel.

16. The gaming system of claim 1, wherein the storage symbols displayed in the storage set of symbol display areas are stored in the memory device for a predetermined quantity of plays of the game.

17. A method of operating a gaming system, the method comprising:

receiving, by a monetary value acceptor, a monetary value;

establishing, by a processor of the gaming system, a credit balance based at least in part on the received monetary value;

accepting, from an input device in a housing of the gaming system, a wager amount;

decreasing, by the processor, the credit balance by the wager amount;

randomly generating a plurality of game symbols for a game set of symbol display areas;

displaying, on a display device of the housing, the plurality of game symbols in the game set of symbol display areas;

randomly generating a plurality of accumulator symbols in an accumulator set of symbol display areas, the accumulator set of symbol display areas being associated with the game set of symbol display areas;

displaying, on the display device, the plurality of accumulator symbols in the accumulator set of symbol display areas;

determining matches between the displayed game symbols and the generated plurality of accumulator symbols;

generating a plurality of storage symbols for a storage set of symbol display areas based on the matches between the displayed plurality of game symbols and the displayed plurality of accumulator symbols, wherein a storage symbol of the plurality of storage symbols is generated based on a match between one game symbol of the displayed plurality of game symbols and one accumulator symbol the displayed plurality of accumulator symbols;

displaying, on the display device, the generated plurality of storage symbols;

determining awards based on the plurality of game symbols;

if a quantity of the plurality of storage symbols is equal to or greater than a predetermined quantity, determine additional awards based on the plurality of storage symbols;

displaying, on the display device, the determined awards and the additional awards;

increasing, by the processor, the credit balance by the determined awards and the additional awards; and issuing another monetary value, by a value dispenser, based on the credit balance upon receipt of a cash out signal.

18. A non-transitory computer-readable storage medium having machine instructions stored therein, the instructions being executable by a processor to cause the processor to:

establish a credit balance based at least in part on a monetary value received by a value acceptor of a gaming device;

place a wager following receipt of a wager input via an input device, the credit balance being decreased by the wager;

randomly generate a plurality of game symbols for a game set of symbol display areas;

display, on a display device of a housing, the plurality of game symbols in the game set of symbol display areas;

randomly generate a plurality of accumulator symbols in an accumulator set of symbol display areas, the accumulator set of symbol display areas being associated with the game set of symbol display areas;

display, on the display device, the plurality of accumulator symbols in the accumulator set of symbol display areas;

determine matches between the displayed game symbols and the generated plurality of accumulator symbols;

generate a plurality of storage symbols for a storage set of symbol display areas based on the matches between the displayed plurality of game symbols and the displayed plurality of accumulator symbols, wherein a storage symbol of the plurality of storage symbols is generated based on a match between one game symbol of the displayed plurality of game symbols and one accumulator symbol the displayed plurality of accumulator symbols;

if a match is determined, generate an indicator associated with a symbol display area of the game set of symbol display areas that displays the matching game symbol, wherein the indicator is also associated with the matching game symbol;

display the generated plurality of storage symbols;

determine awards based on the plurality of game symbols;

if a quantity of the plurality of storage symbols is equal to or greater than a predetermined quantity, determine additional awards based on the plurality of storage symbols;

display, on the display device, the determined awards and the additional awards;

increase, by the processor, the credit balance by the determined awards and the determined additional awards; and issue value from a value dispenser based on the credit balance upon receipt of a cash out signal.

19. The gaming system of claim 1, wherein at least one of the generated plurality of storage symbols persists for more than one play of a game.

* * * * *